US009941560B2

(12) United States Patent
Sarabandi et al.

(10) Patent No.: US 9,941,560 B2
(45) Date of Patent: Apr. 10, 2018

(54) NON-CONTACT ON-WAFER S-PARAMETER MEASUREMENTS OF DEVICES AT MILLIMETER-WAVE TO TERAHERTZ FREQUENCIES

(71) Applicant: THE REGENTS OF THE UNIVERSITY OF MICHIGAN, Ann Arbor, MI (US)

(72) Inventors: Kamal Sarabandi, Ann Arbor, MI (US); Meysam Moallem, Ann Arbor, MI (US); Armin Jam, Ann Arbor, MI (US)

(73) Assignee: The Regents of The University of Michigan, Ann Arbor, MI (US)

( * ) Notice: Subject to any disclaimer, the term of this patent is extended or adjusted under 35 U.S.C. 154(b) by 142 days.

(21) Appl. No.: 14/978,146

(22) Filed: Dec. 22, 2015

(65) Prior Publication Data

US 2016/0181681 A1 Jun. 23, 2016

Related U.S. Application Data

(60) Provisional application No. 62/095,418, filed on Dec. 22, 2014.

(51) Int. Cl.
*H01P 3/00* (2006.01)
*H01P 5/02* (2006.01)
(Continued)

(52) U.S. Cl.
CPC ..... *H01P 1/025* (2013.01); *H01P 3/006* (2013.01); *H01P 5/107* (2013.01); *H01P 5/12* (2013.01)

(58) Field of Classification Search
CPC .. H01P 3/003; H01P 3/006; H01P 3/12; H01P 5/085
See application file for complete search history.

(56) References Cited

U.S. PATENT DOCUMENTS 5,003,253 A 3/1991 Majidi-Ahy et al.
5,990,768 A * 11/1999 Takahashi ..... H01P 3/084 257/664
(Continued)

FOREIGN PATENT DOCUMENTS

CN 103474733 A 12/2013

OTHER PUBLICATIONS

Armin Jam et al "A Non-Contact Waveguide Probe for On-Wafer S-Parameter Measurements for Submillimeter-Wave to Terahertz Band", IEEE Transactions on Terahertz Science and Technology, vol. 4, No. 4 (Jul. 2014).
(Continued)

*Primary Examiner* — Dean Takaoka
*Assistant Examiner* — Alan Wong
(74) *Attorney, Agent, or Firm* — Harness, Dickey & Pierce, P.L.C.

(57) ABSTRACT

A broadband fully micromachined transition from rectangular waveguide to cavity-backed coplanar waveguide line for submillimeter-wave and terahertz application is presented. The cavity-backed coplanar waveguide line is a planar transmission line that is designed and optimized for minimum loss while providing 50 Ohm characteristic impedance. This line is shown to provide less than 0.12 dB/mm loss over the entire J-band. The transition from cavity-backed coplanar waveguide to a reduced-height waveguide is realized in three steps to achieve a broadband response with a topology amenable to silicon micromachining. A novel waveguide probe measurement setup is also introduced and utilized to evaluate the performance of the transitions.

12 Claims, 26 Drawing Sheets

(51) Int. Cl.

| | |
|---|---|
| ***H01P 1/02*** | (2006.01) |
| ***H01P 5/107*** | (2006.01) |
| ***H01P 5/12*** | (2006.01) |

(56) References Cited

U.S. PATENT DOCUMENTS

| | | | | |
|---|---|---|---|---|
| 7,030,721 | B2 * | 4/2006 | Yoshida | H01P 11/00 333/246 |
| 7,400,222 | B2 * | 7/2008 | Kwon | H01P 3/06 333/243 |
| 7,482,894 | B2 * | 1/2009 | Wu | H01P 5/02 330/124 R |
| 7,755,445 | B2 * | 7/2010 | Dutta | H01P 3/084 174/117 AS |
| 7,782,156 | B2 * | 8/2010 | Woods | H01P 5/107 333/254 |
| 2014/0253262 | A1 | 9/2014 | Hsieh et al. | |
| 2014/0266493 | A1 * | 9/2014 | Tageman | H01P 5/08 333/26 |

OTHER PUBLICATIONS

Meysam Moallem, "A Broadband, Micromachined Rectangular Waveguide to Cavity-Backed Coplanar Waveguide Transition Using Impedance-Taper Technique", IEEE Transactions on Terahertz Science and Technology, vol. 4, No. 1, (Jan. 2014).

* cited by examiner

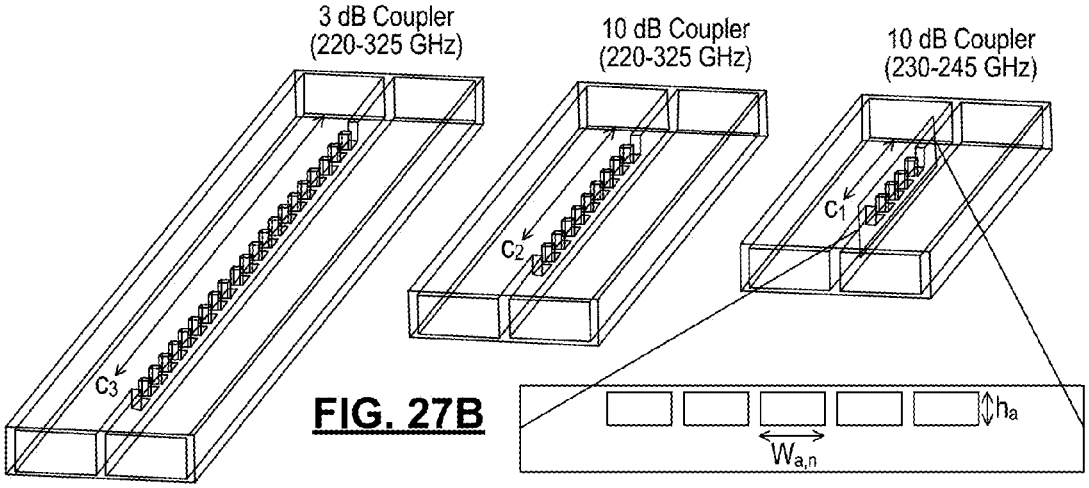
FIG. 27B
FIG. 27C
FIG. 27A
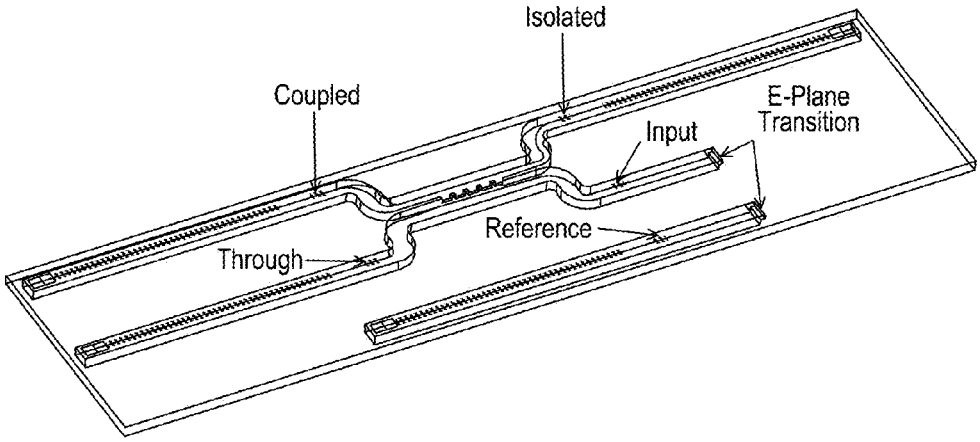
FIG. 28

NON-CONTACT ON-WAFER S-PARAMETER MEASUREMENTS OF DEVICES AT MILLIMETER-WAVE TO TERAHERTZ FREQUENCIES

CROSS-REFERENCE TO RELATED APPLICATIONS

This application claims the benefit of U.S. Provisional Application No. 62/095,418, filed on Dec. 22, 2014. The entire disclosure of the above application is incorporated herein by reference.

GOVERNMENT CLAUSE

This invention was made with government support under W911NF-08-2-0004 awarded by the U.S. Army/ARO. The Government has certain rights in this invention.

FIELD

The present disclosure relates to measurement techniques for characterization of active and passive waveguide based components and devices as well as monolithic microwave integrated circuits (MMIC) at millimeterwave, sub millimeterwave and terahertz frequencies.

BACKGROUND

With the advent of active and passive MMIC technology, there is an increasing interest for developing integrated high millimeter-wave (MMW) and terahertz systems for applications in ultrafastwireless communication and short-range miniature radars for navigation and imaging. The short wavelength at these frequency bands enables the integration of antennas and other waveguide-based passive components such as couplers and filters with MMIC active modules to develop fully integrated communication links and radar front-ends. These waveguide based components have been implemented on silicon wafers using micromachining technology. On the other hand, active MMIC modules are typically implemented on planar transmission lines. Hence, a reliable transition from on-wafer waveguides to planar transmission lines is essential to realize fully integrated systems.

A number of transition approaches from planar transmission lines to rectangular waveguide using microfabrication technology for W-band and higher frequencies have been reported in the literature. All of these transitions have complex 3-D geometries which require assembly of various parts. Considering the dimensions in sub-MMW and terahertz region, implementation of such transitions with acceptable accuracy becomes very difficult. Hence, fully micromachined transitions which do not require assembly of parts are preferred for these high frequency applications. A 2.5-D fully micromachined resonant-based transition has been proposed. In this design, the transition is realized using two resonant structures: a shorted section of transmission line with a pin inside the waveguide and an E-plane step discontinuity. However, due to the resonant nature of the transition, the fractional bandwidth is limited to 17%. In addition, the performance of the transition is sensitive to good contact with the shorting pin and the waveguide step height which are subject to micromachining tolerances.

Microstrip-to-rectangular waveguide transitions using the impedance-tapering technique have been reported in the literature. In these structures, a multistep ridged-waveguide impedance taper is typically used to convert the quasi-TEM mode on the microstrip line to the $TE_{01}$ mode in the rectangular waveguide. However, the particular geometry of these designs where the ridged section extends over the planar transmission line (i.e., microstrip) cannot be easily fabricated by micromachining where both the waveguide ceiling and the planar transmission line are at same level (wafer's top surface). Hence, for high-frequency applications, this disclosure presents a novel impedance taper transition is proposed which is compatible with silicon micromachining.

This section provides background information related to the present disclosure which is not necessarily prior art.

SUMMARY

This section provides a general summary of the disclosure, and is not a comprehensive disclosure of its full scope or all of its features.

In one aspect of this disclosure, a cavity-backed coplanar waveguide is presented. The cavity-backed coplanar waveguide is comprised of: a ground plane member having a trench formed in a top surface thereof, such that the trench has a longitudinal axis and extends from one side of the ground plane member to an opposing side of the ground plane member; a metal layer disposed on and substantially covering the top surface of the ground plane member, including covering walls forming the trench; a dielectric membrane; and a microstrip formed on the dielectric membrane and configured to propagate a signal with a frequency in millimeter to terahertz range. The dielectric membrane attaches to the top surface of the ground plane member, such that the longitudinal axis of the microstrip aligns with the longitudinal axis of the trench, and the microstrip is suspended in and spatially separated from walls of the trench. Additionally, the dimensions of the microstrip in relation to the trench may be configured to minimize insertion loss while maintaining single transverse electromagnetic mode propagation of the signal.

An in-plane transition waveguide may be used to interconnect a standard sized rectangular waveguide with the cavity-backed coplanar waveguide or another waveguide having a height less than the height of the standard sized rectangular waveguide. The in-plane transition waveguide includes: a substrate defining a longitudinal axis with an input side surface and an output side surface at opposing ends of the longitudinal axis; an input transition section having a trench formed into a top surface of the substrate, where the trench projects inward from the input side surface of the substrate and is configured to receive a signal with a frequency in millimeter to terahertz range; a first waveguide section formed on the substrate adjacent to and integral with the input transition waveguide section; a second waveguide section formed on the substrate adjacent to and integral with the first waveguide section; and an output waveguide section formed in the substrate adjacent to and integral with the second waveguide section.

The first waveguide section has a channel formed in the top surface of the substrate, where the channel defines a planar bottom surface that is coplanar with bottom surface of the trench, the first waveguide section having a v-shape groove formed in an end of the first waveguide section that is facing the output side surface, such that the v is parallel with bottom surface of the trench and the v opens towards the output side surface of the substrate.

The second waveguide section also has a channel formed in the top surface of the substrate, wherein the channel defines a planar bottom surface that is recessed below the planar bottom surface of the channel in the first waveguide section, the second planar section having a v-shape groove formed in an end of the second waveguide section facing the output side surface, such that the v is parallel with bottom surface of the trench and the v opens towards the output side surface of the substrate.

Lastly, the output waveguide section has a channel formed in the top surface of the substrate and extending from the second waveguide section to the output side surface of the substrate, wherein the channel is sized to receive a rectangular waveguide.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIG. 7A-7E are diagrams of an example embodiment of an in-plane transition waveguide.

Figure 10A:
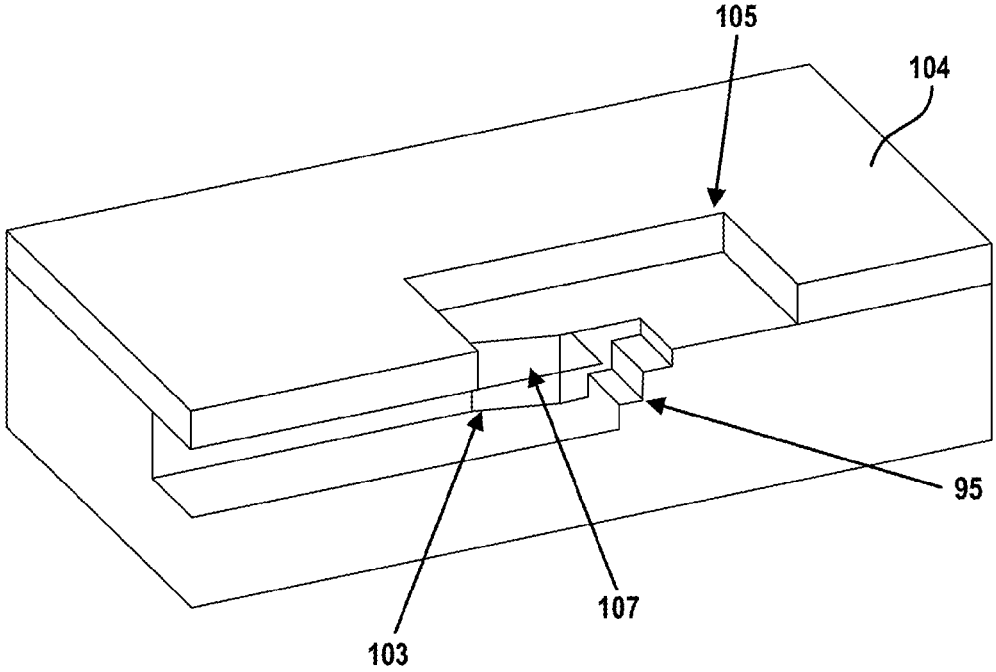
Figure 10B:
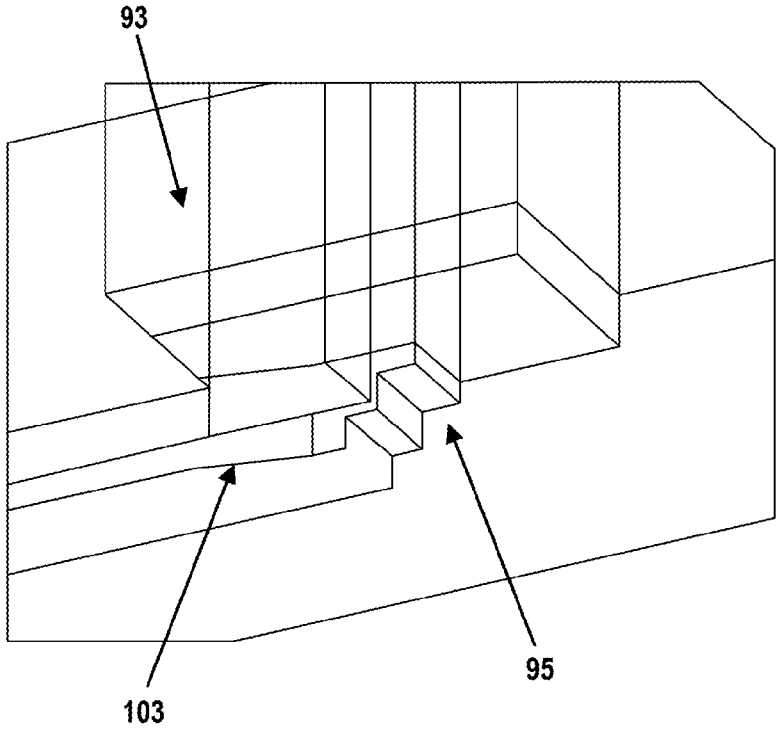
Figure 10C:
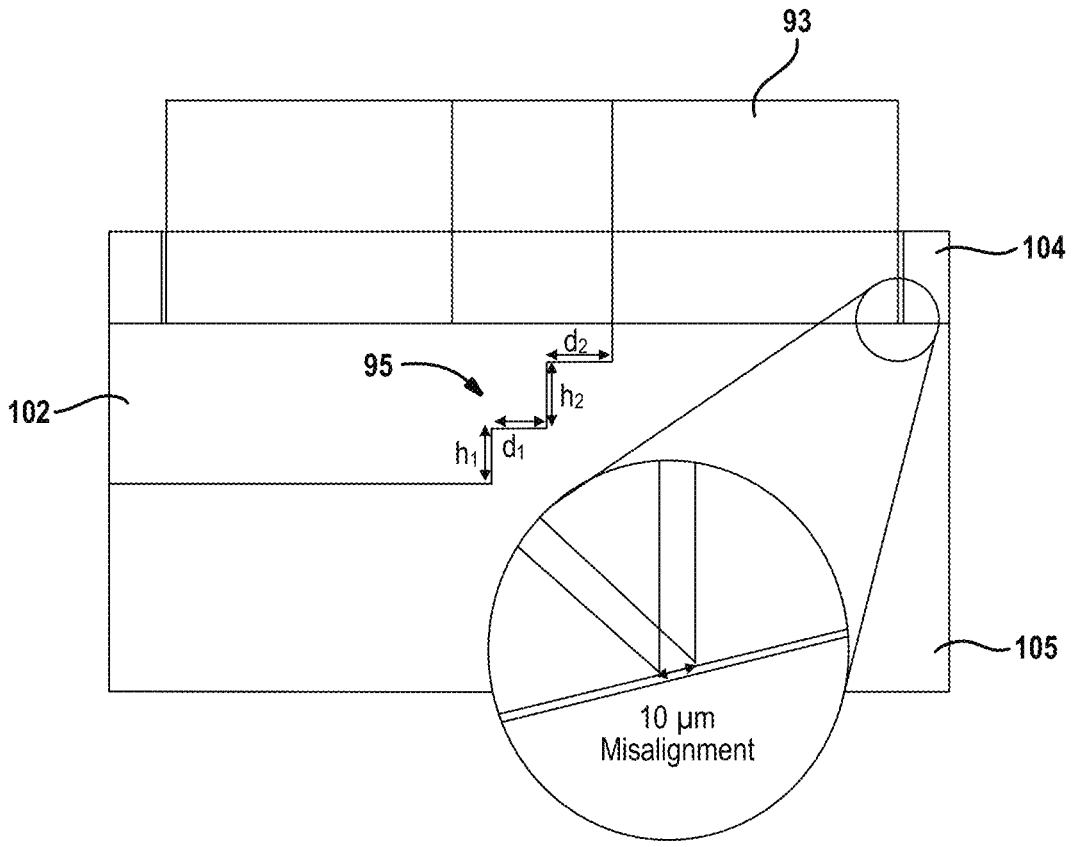

FIGS. 10A-10C are schematics of the micromachined waveguide probe to on-wafer waveguide transition showing (a) 3D view of half of the structure showing the stepped E-plane bend transition without the waveguide probe; (b) 3D view of half of the structure showing the waveguide probe in contact with stepped E-plane bend transition; and (b) side view of the structure showing an alignment accuracy of 10 μm, respectively.

Figure 11:
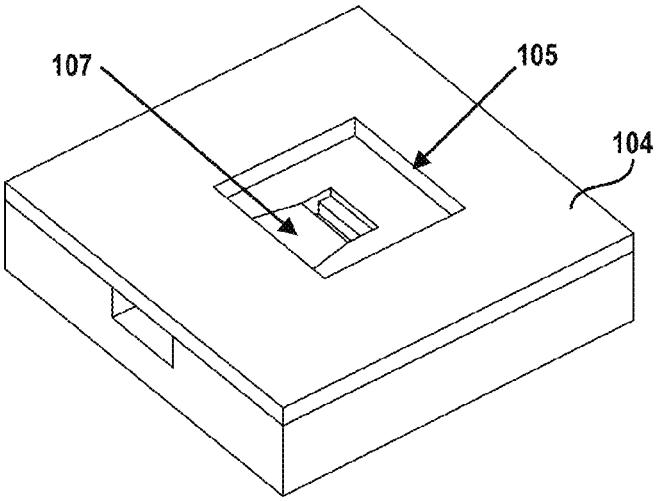

FIG. 11 is a diagram showing the probe opening on the top wafer for accurate alignment of the probe with the waveguide opening.

Figure 12:
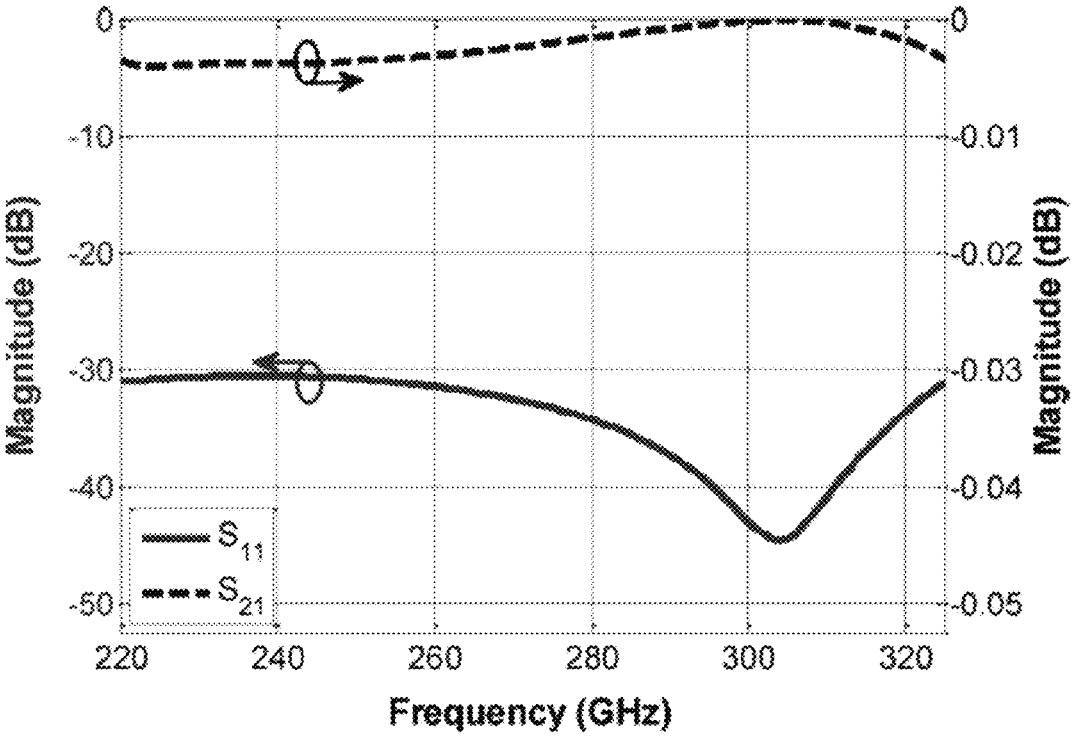

FIG. 12 is a graph showing full-wave simulation results of the optimized two-step transition from the WR3 waveguide probe to on-wafer WR3 waveguide.

Figure 13A:
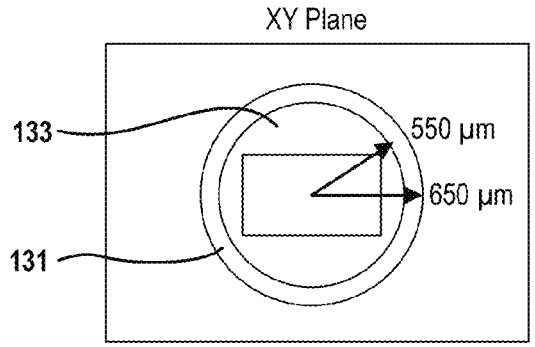
Figure 13B:
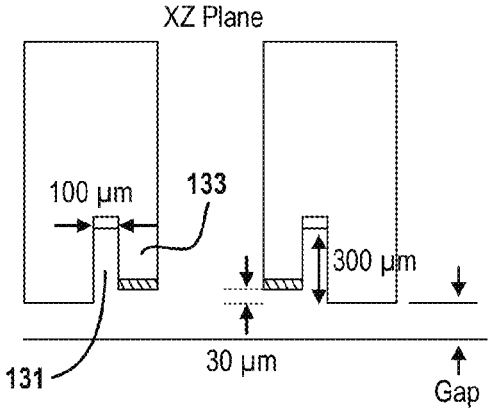

FIGS. 13A and 13B are diagrams of an example choke design for use on the waveguide probe.

Figure 14:
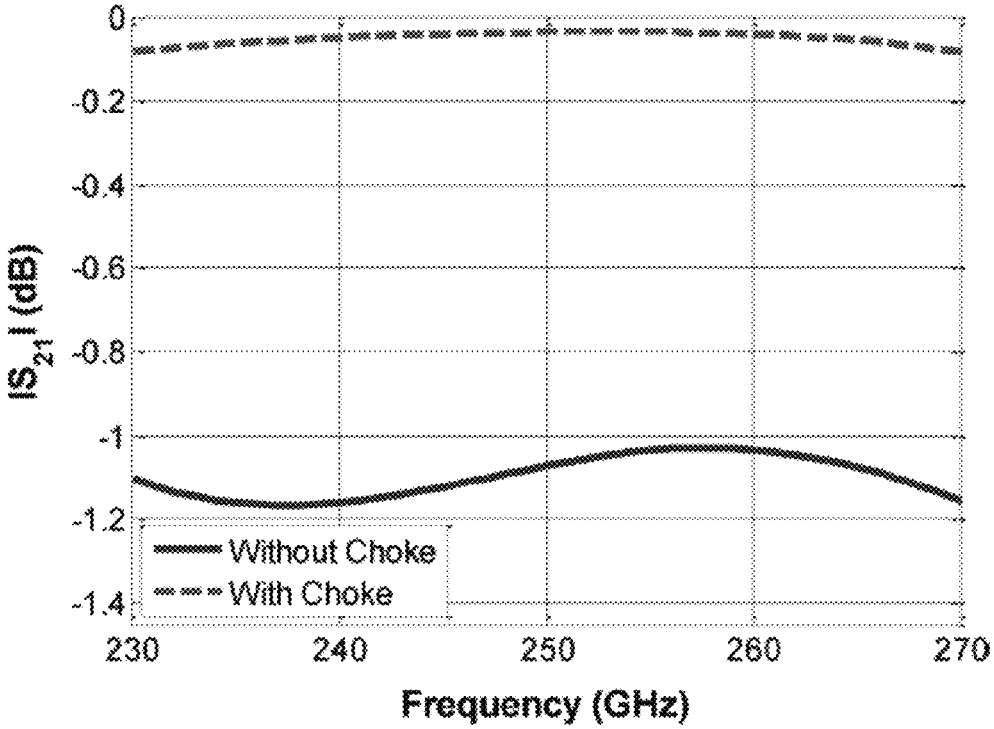

FIG. 14 is a graph illustrating full-wave simulation results of the effect of the choke on the performance of the measurements.

Figure 15:
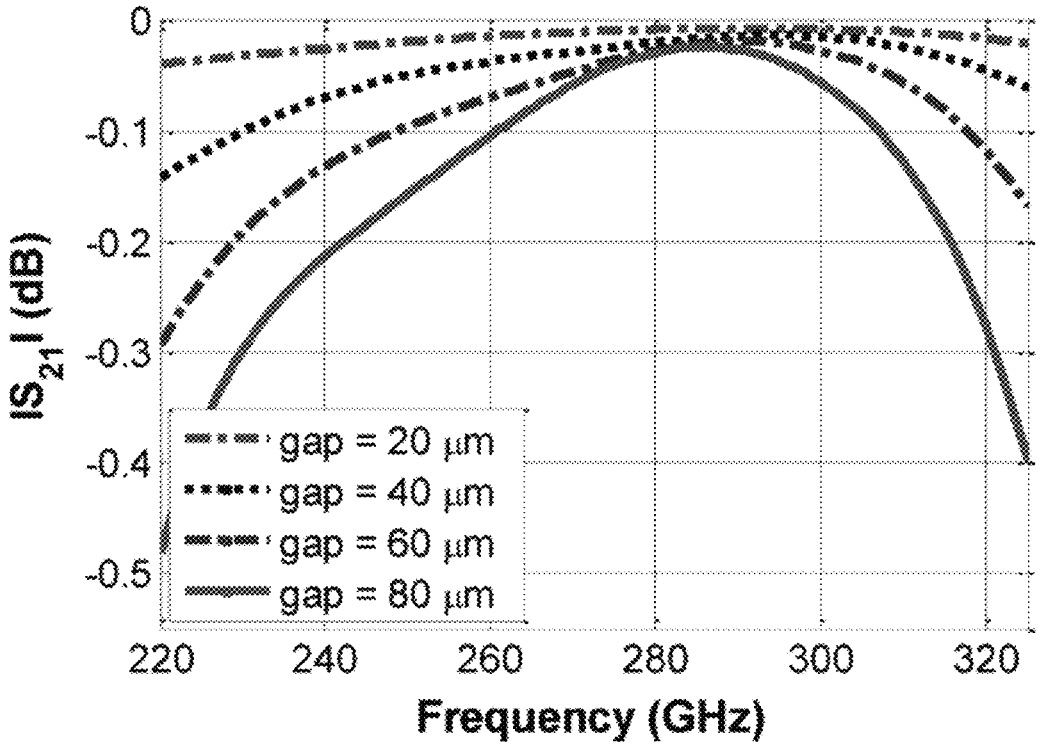

FIG. 15 is a graph illustrating full-wave simulation results of the optimized full-band choke design for different values of gap between the probe cross-section and the surface of the wafer.

Figure 16:
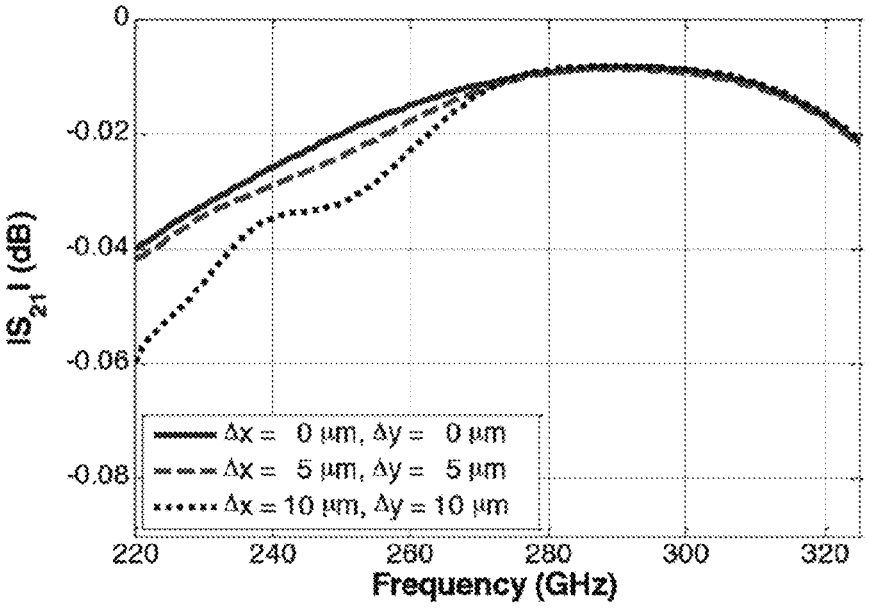

FIG. 16 is a graph illustrating the transmission coefficient of the transition for different misalignments of the waveguide probe with the on-wafer waveguide opening.

Figure 17:
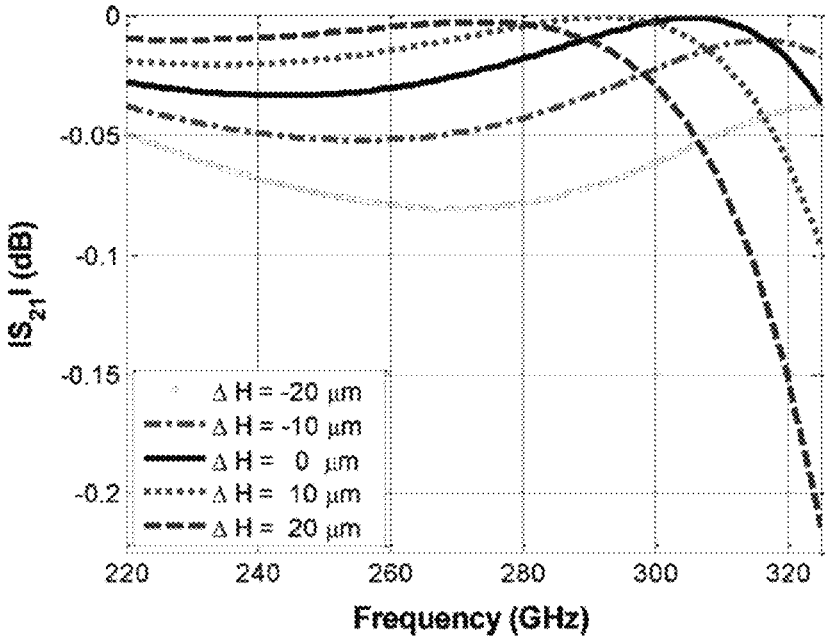

FIG. 17 is a graph illustrating variations in transmission coefficient of the transition with respect to height variations of the micromachined steps in the DRIE process.

Figure 18:
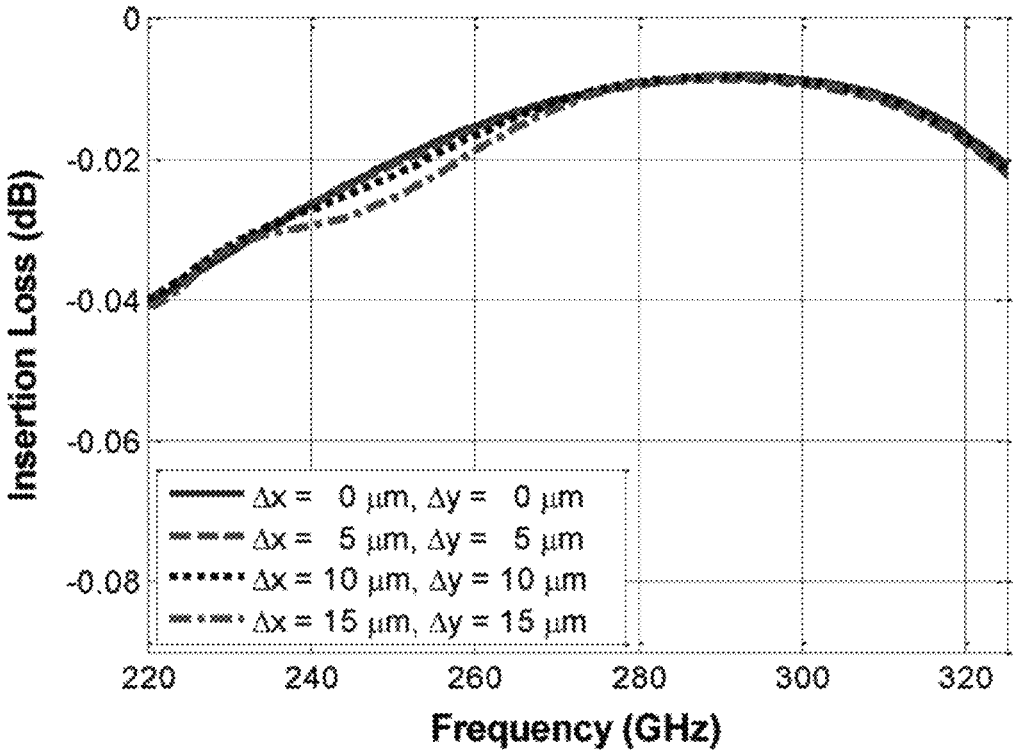

FIG. 18 is a graph illustrating transmission coefficient of the transition for different displacements between the centers of the milled choke and the waveguide.

Figure 19:
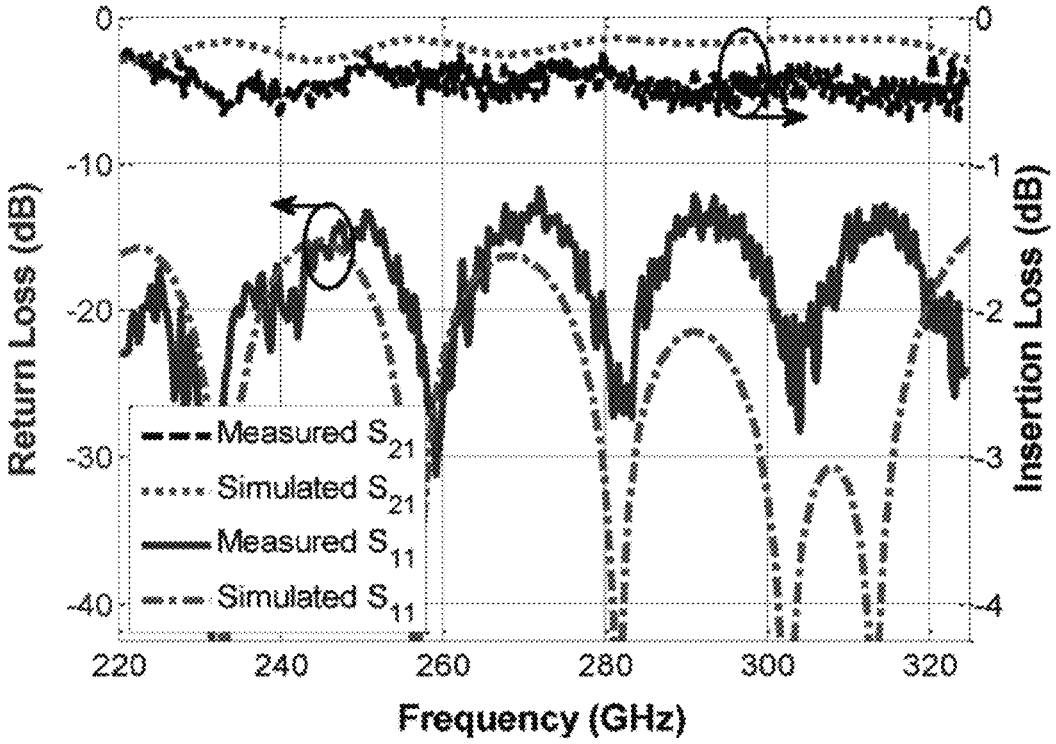

FIG. 19 is a graph illustrating simulated and measured S-parameter of an on-wafer back-to-back transition.

Figure 20A:
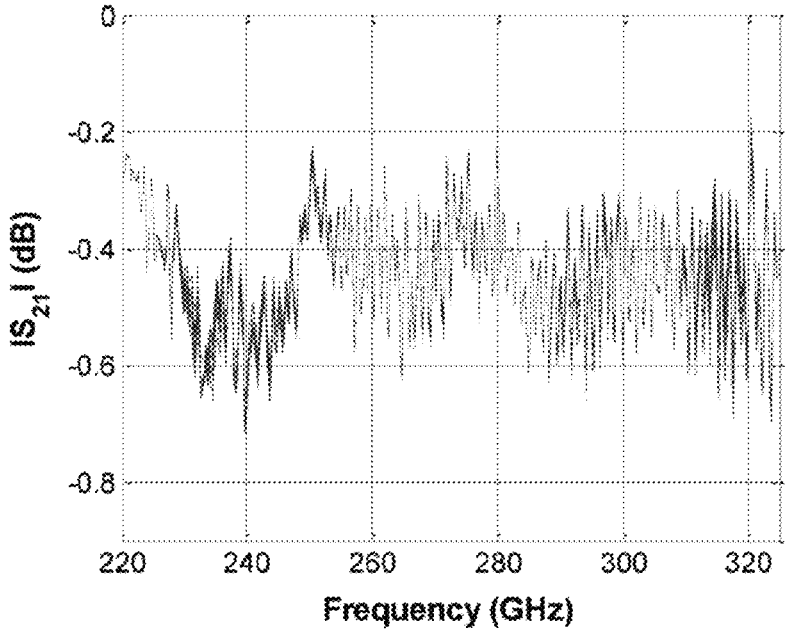
Figure 20B:
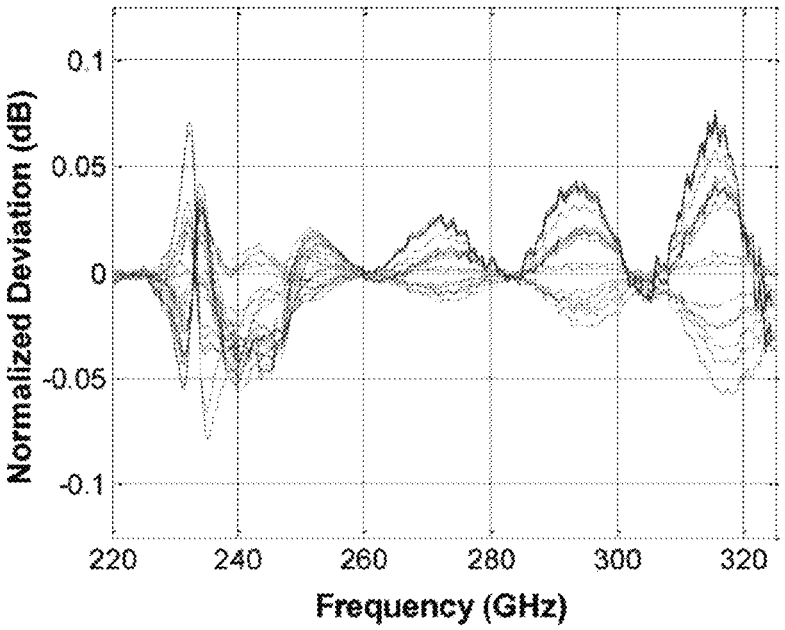

FIGS. 20A and 20B are graphs illustrating (a) repeated transmission coefficient measurements of a single on-wafer back-to-back transition (N=30), and (b) transmission coefficient of the back-to-back transition for repeated measurements normalized to a reference measurement, respectively.

Figure 21:
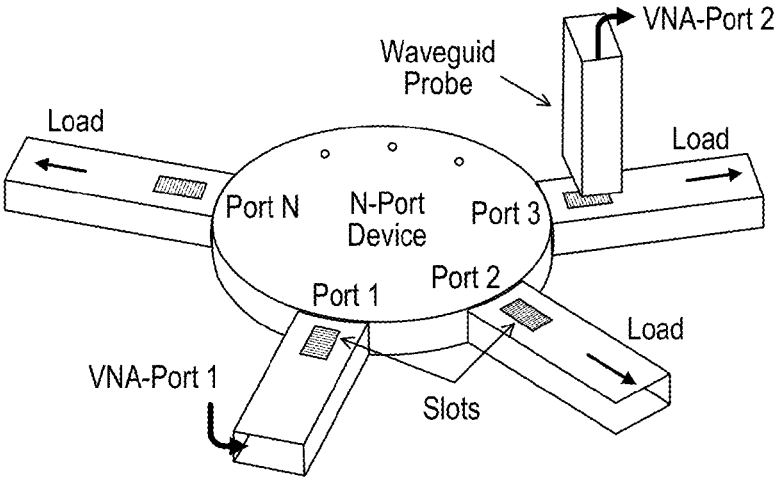

FIG. 21 is a schematic of the proposed multiport S-parameter measurement technique using a two-port measurement system.

Figure 22A:
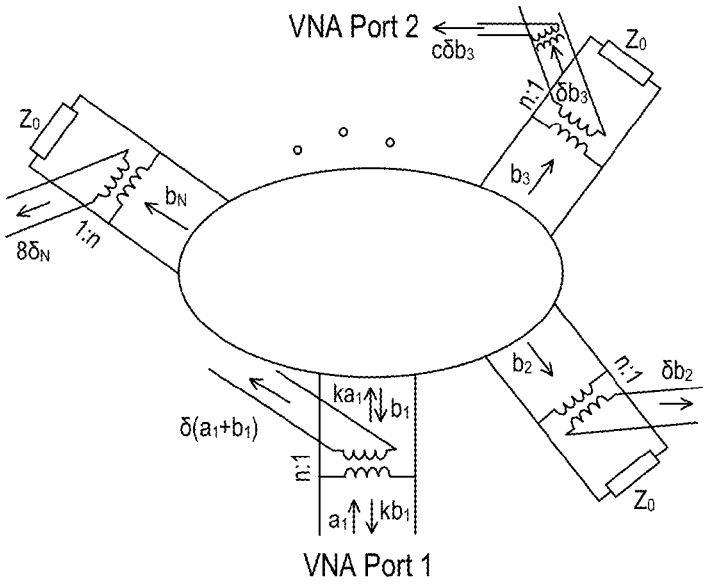
Figure 22B:
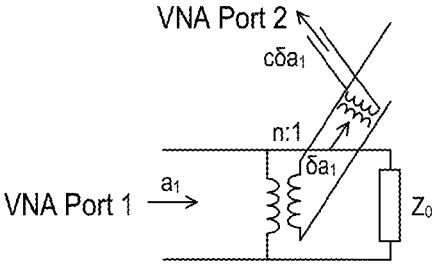

FIGS. 22A and 22B show a circuit model of the proposed S-parameter measurement method (a) N-port device measurement configuration (port 3 is being measured in the schematic); and (b) reference waveguide transition for characterizing the effect of the excitation port, respectively.

Figure 23A:
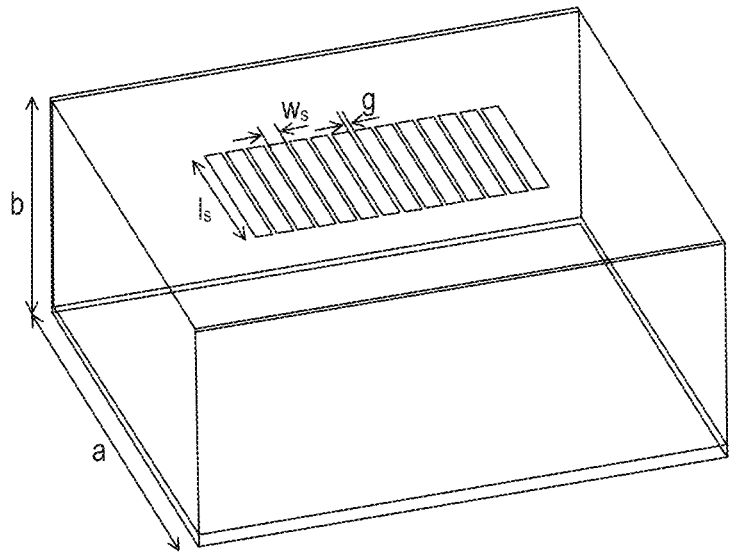

FIG. 23A is a schematic of the optimized 14-slot array.

Figure 23B:
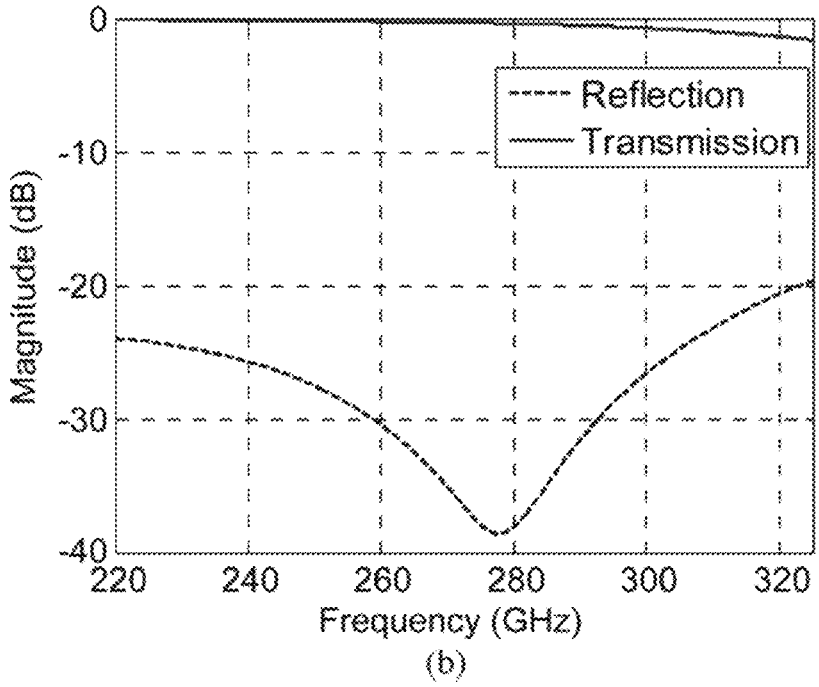

FIG. 23B is a graph illustrating reflection and transmission of the waveguide section with slots.

Figure 24A:
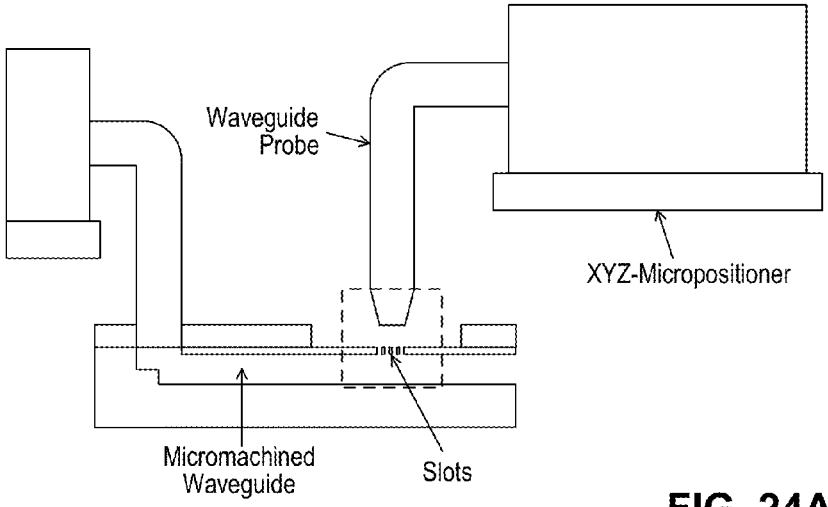
Figure 24B:
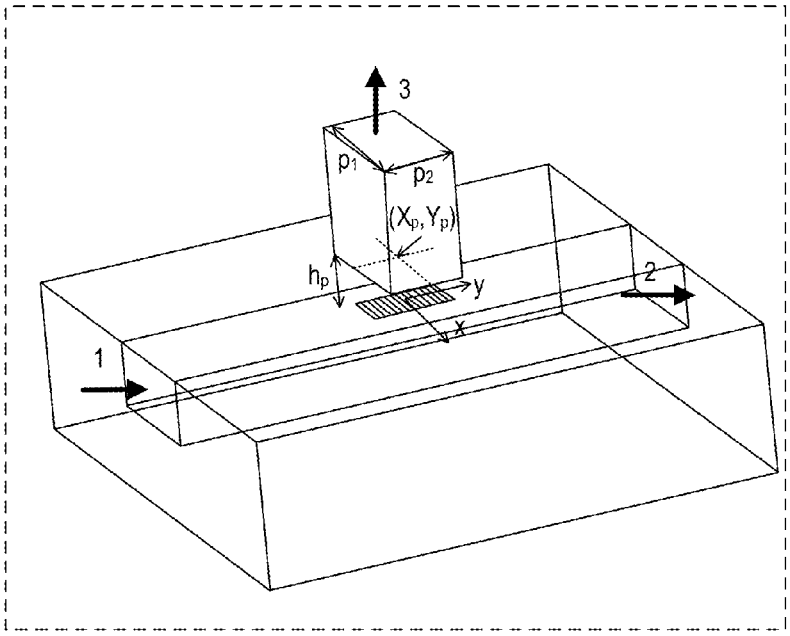

FIGS. 24A and 24B are diagrams depicting (a) a noncontact measurement schematic consisting of the MMW frequency extenders, micropositioner, and waveguide probes; and (b) an optimized slot array in the presence of the near-field waveguide probe.

Figure 25A:
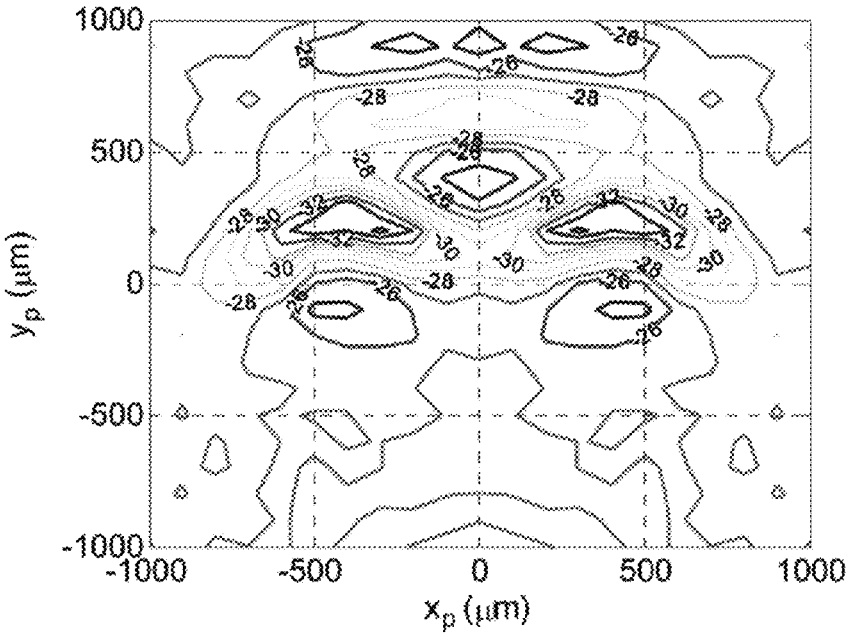
Figure 25B:
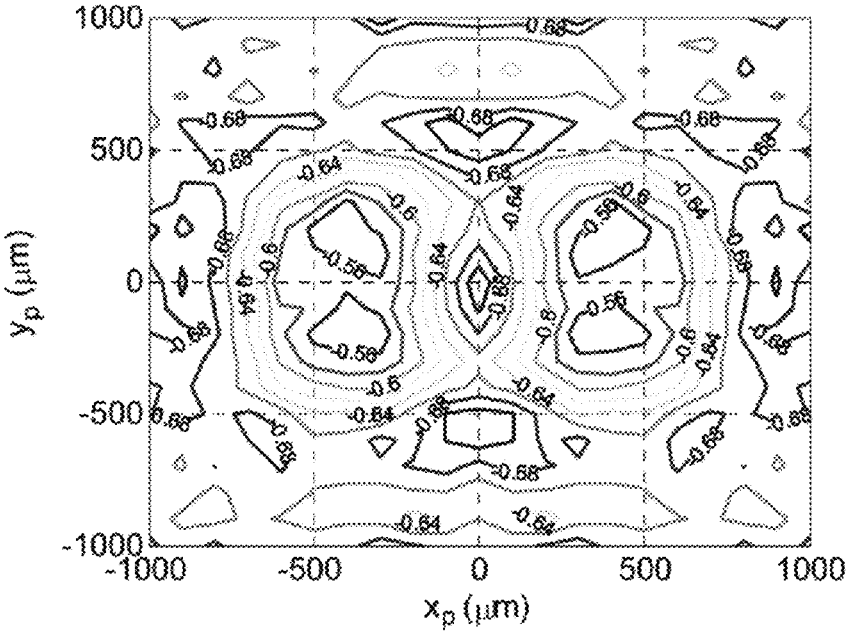
Figure 25C:
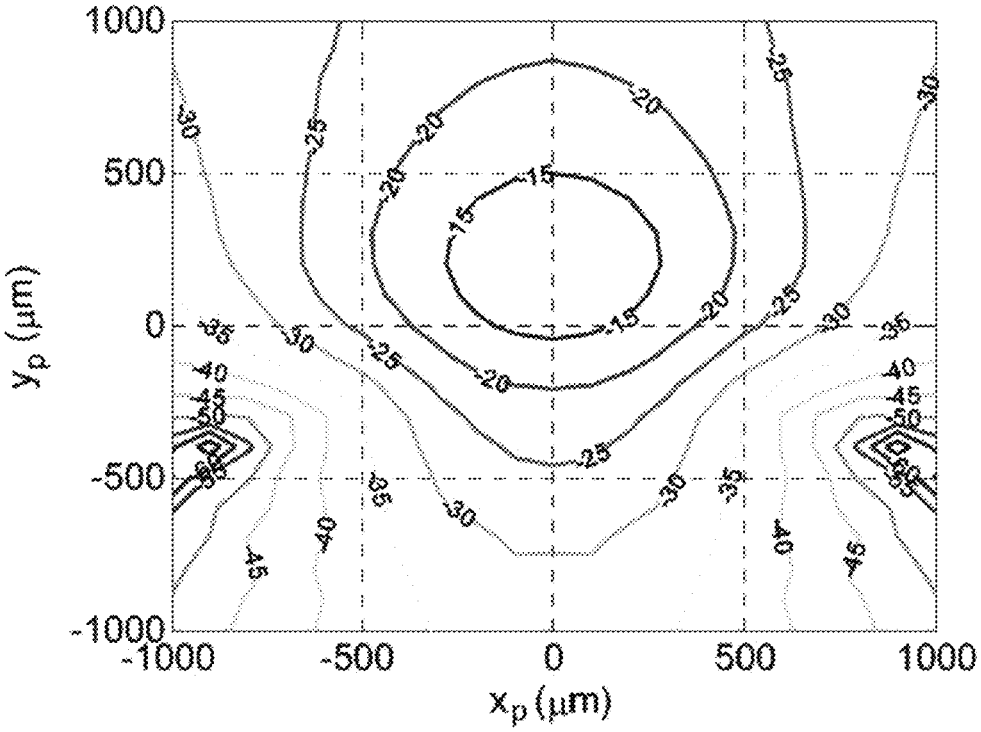

FIGS. 25A-25C are graphs illustrating a full-wave simulation of the slot array coupling versus the position of the near-field probe for (a) Reflection ($S_{11}$); (b) transmission ($S_{21}$); and (c) coupled power to the probe ($S_{31}$), respectively.

Figure 26A:
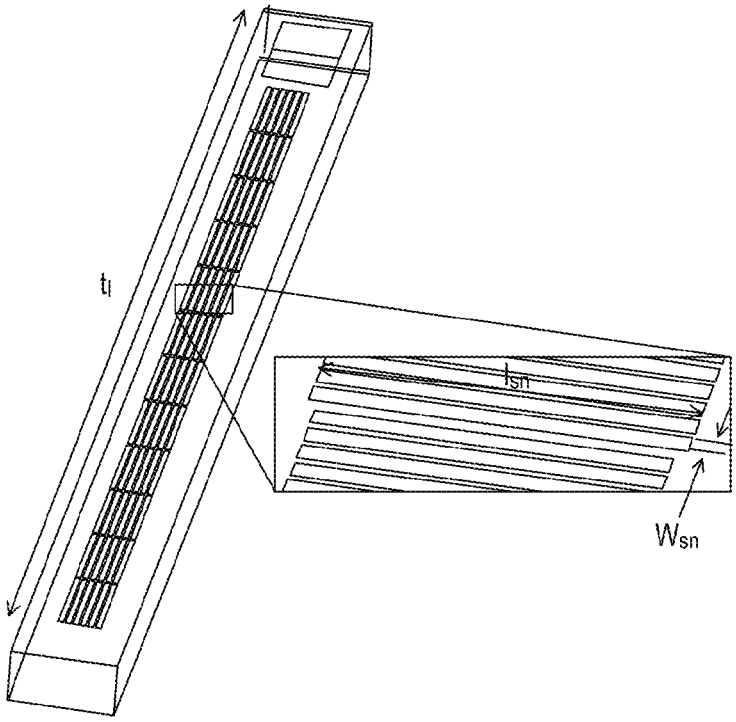
Figure 26B:
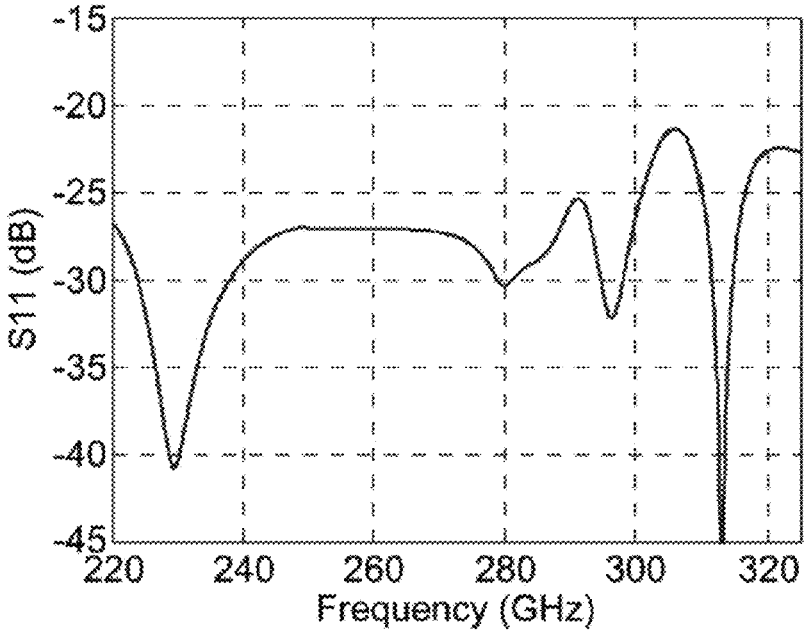

FIG. 26A is a diagram depicting matching load based on slot array over micromachined waveguides FIG. 26B is a graph illustrating simulated return loss of the optimized load.

FIGS. 27A-27C are diagrams of micromachined sidewall aperture couplers: 1) Full-band 3-dB coupler; 2) Full-band 10-dB coupler; and 3) 230-245 GHz 10-dB coupler, respectively.

FIG. 28 is a schematic of the example test configuration.

Figure 29A:
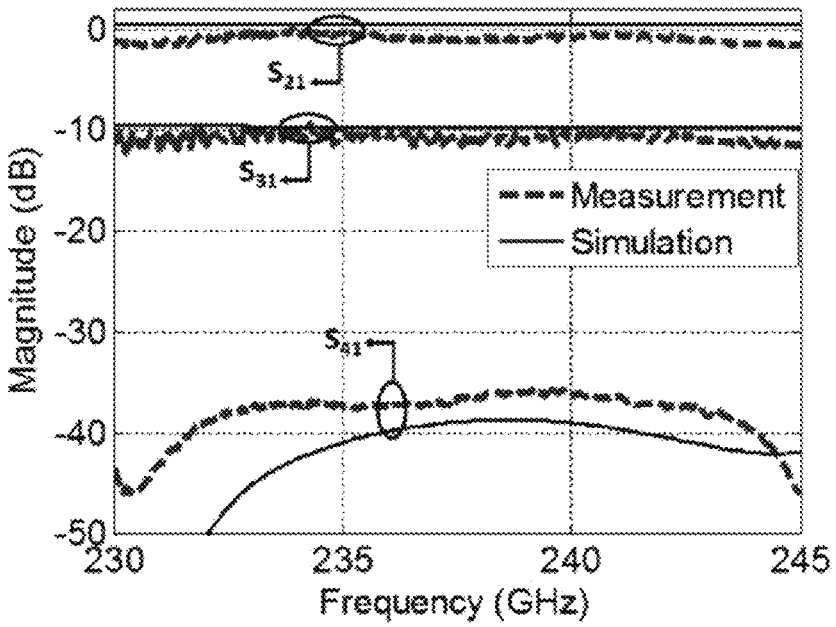
Figure 29B:
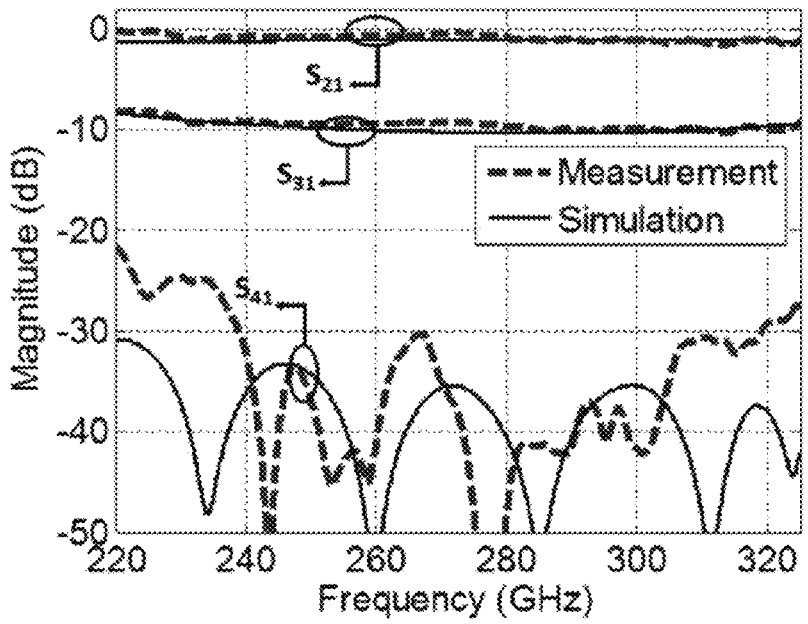
Figure 29C:
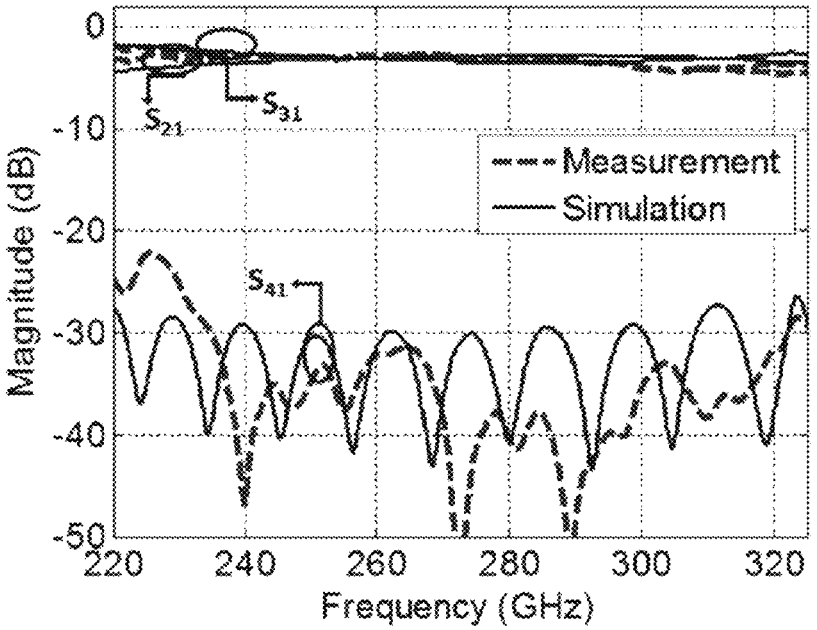

FIGS. 29A-29C are graphs showing S-parameters of the directional couplers: (a) 10-dB coupler (230-245 GHz), (b) 10-dB coupler (220-325 GHz), and (c) 3-dB coupler (220-325 GHz), respectively.

Figure 30:
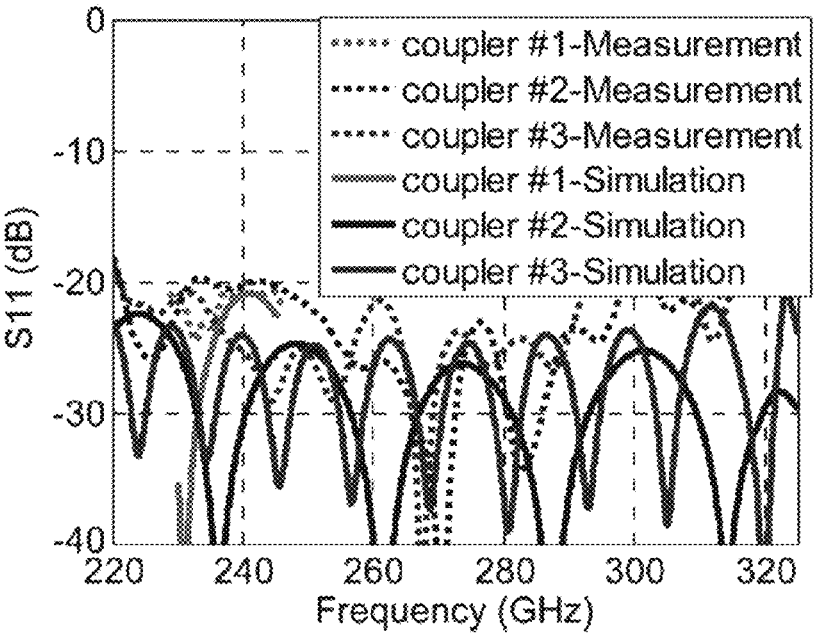

FIG. 30 is a graph showing a return loss of the directional couplers.

Corresponding reference numerals indicate corresponding parts throughout the several views of the drawings.

DETAILED DESCRIPTION

Example embodiments will now be described more fully with reference to the accompanying drawings.

Coplanar waveguides (CPWs) are the most widely used planar transmission line in MMIC applications due to their simplicity of fabrication and integration of components in series or shunt. However, there are some inherent drawbacks with the conventional CPW design. These lines support quasi-TEM wave propagation which makes them dispersive and limits their performance for wideband applications. They can also support substrate higher order modes on relatively thick substrates. However, the most important factor that limits the performance of planar transmission lines in general and CPW lines in particular at sub-millimeter-wave and terahertz frequencies is the high insertion loss. Dielectric loss and ohmic loss are the two sources of loss in planar transmission lines. Different techniques have been used in the past to reduce the source of losses in CPW lines. In order to maintain certain characteristic impedance for these lines, the gap size between the line and the ground must be significantly reduced to compensate for the removal of the substrate in these substrate-less lines. Reduction in the gap size cause two problems: 1) the gap realization becomes difficult and sensitive to microfabrication errors and 2) the field intensity at the gap drastically increases which resists in significant increase in ohmic loss and limits the maximum power handling on the line. Hence, low-impedance (50Ω) designs are usually not considered for substrate-less membrane-supported designs reported in the literature. However, since active circuit modules and MMIC components are mainly designed based on 50-Ω impedance, a transmission line with 50-Ω characteristic impedance is desirable to integrate these components without mismatch problems.

Figure 1:
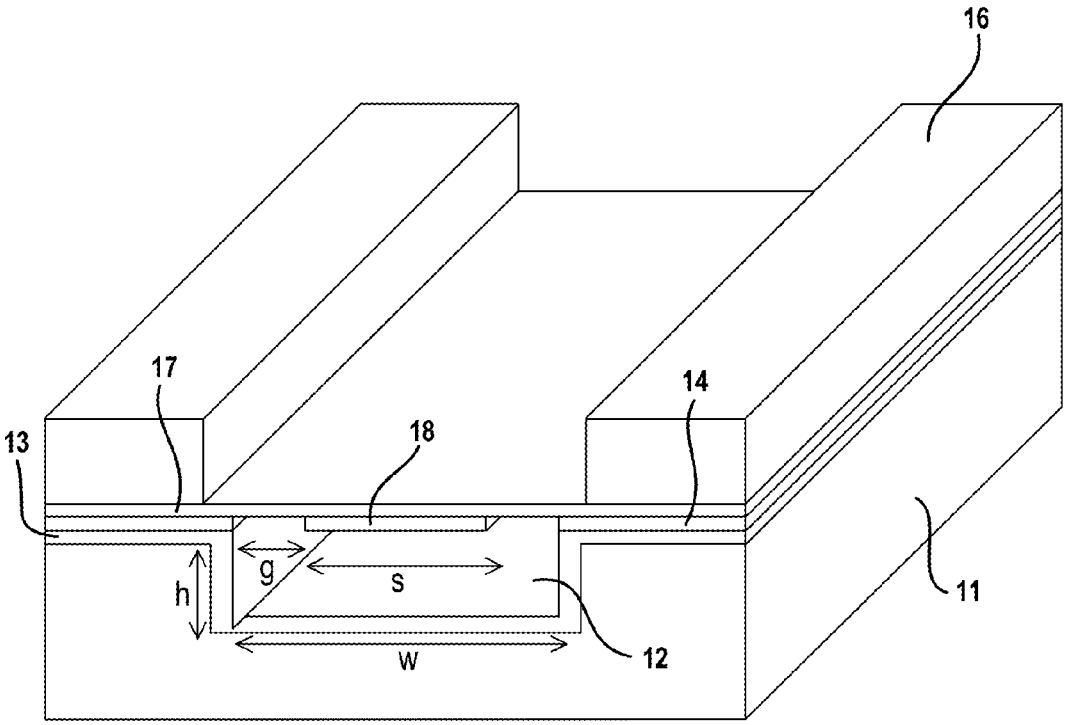
FIG. 1 is a perspective view of a cavity-backed coplanar waveguide.

Referring to FIG. 1, design of a 50-Ω, dispersion-less, planar transmission line optimized for minimum insertion loss while maintaining single TEM mode propagation for sub-MMW and terahertz applications is first presented. In an example embodiment, a center conductor (or microstrip) is suspended over an air-filled metallic trench with a thin dielectric membrane. Removal of dielectric substrate from the signal path eliminates the dielectric loss. This structure also allows for pure TEM mode propagation eliminating signal dispersion.

More specifically, the cavity-backed coplanar waveguide 10 is formed from two substrates: an upper substrate and a lower substrate. The lower substrate 11 has a trench 12 formed in a top surface thereof and extends from one side of the substrate to the opposing side of the substrate. A metal layer 13 (e.g. gold) is deposited onto and substantially covers the top surface of the lower substrate 11, preferably covering the walls forming the trench 12. In the example embodiment, the trench has shape of a rectangular cuboid with a height (h) and a width (w). Other shapes for the trench 12 are also contemplated by this disclosure. The lower substrate 11 may be comprised of silicon, silicon dioxide, quartz or any other suitable material amenable to micromachining; whereas, the metal layer may be comprised of gold, silver, aluminum with titanium or chromium or other suitable metals which adhere to the substrate.

A dielectric membrane 17 is formed on at least one side of the upper substrate 16. A metal layer 14 is then formed in the dielectric membrane 17. From the metal layer 14, a microstrip 18 is formed, for example by patterning. The microstrip 18 is coplanar with the remainder of the metal layer 14 with a gap (g) separating the microstrip 18 from the adjacent portion of the metal layer 14. In the example embodiment, the microstrip 18 is in shape of a rectangular cuboid although other shapes are contemplated by this disclosure. In a similar manner, the upper substrate 16 may be comprised of silicon, silicon dioxide, or any other suitable material amenable to micromachining; whereas, the metal layer may be comprised of gold, silver, aluminum with titanium or chromium or other suitable metals which adhere to the substrate.

Figure 2A:
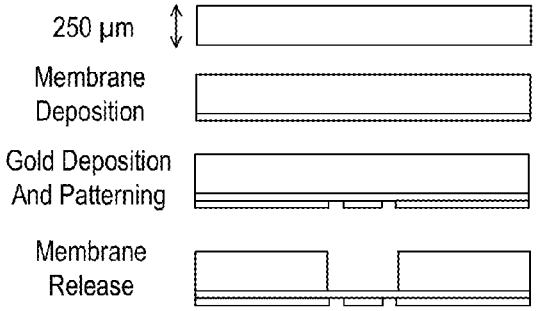
FIGS. 2A-2C are cross-sectional views depicting an example fabrication method for the cavity-backed coplanar waveguide.
Figure 2B:
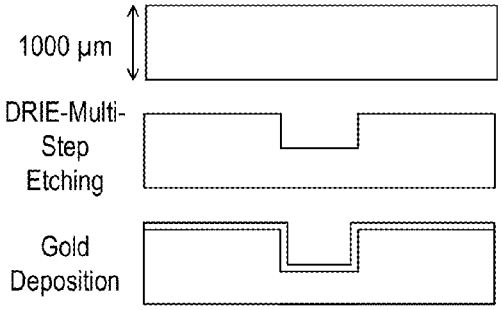
Figure 2C:
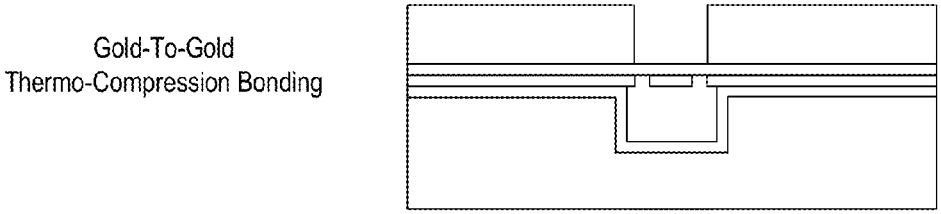

Referring to FIGS. 2A-2C, the cavity-backed coplanar waveguide 10 is constructed from two separate substrates: the upper substrate 16 and the lower substrate 11. In FIG. 2A, the dielectric membrane 17 is deposited onto one side of the upper substrate 16. A metal layer 14 is then deposited onto the dielectric membrane 17. The metal layer is patterned and removed to form the microstrip 18 which flanked on both sides by coplanar lateral conductors. In an example embodiment, the upper substrate 16, which has a thickness of 250 μm, supports a 1 μm thick deposited dielectric membrane 17 that forms the top of the waveguide. In one embodiment, the upper substrate 16 is removed in an area above the microstrip as indicated at 21, where the area has a length that corresponds to the length of the microstrip 18 and a width that corresponds to the width of the trench.

In a similar manner, the lower substrate 11 is fabricated as shown in FIG. 2B. First, the trench 12 is formed in the top surface of the lower substrate 11, for example using an etching process. A metal layer 13 is then deposited onto the top surface of the lower substrate 11, such that the metal covers the exposed surfaces of the trench 12.

Lastly, the upper substrate 16 attaches to the lower substrate 11 as seen in FIG. 2C. Specifically, the upper substrate 16 is oriented with respect to the lower substrate 11, such that the longitudinal axis of the microstrip 18 aligns with the longitudinal axis of the trench 12, and the microstrip 18 is suspended in and spatially separated from walls of the trench 12 as best seen in FIG. 1. In the example embodiment, the two substrates are bonded to each other using gold-to-gold thermo-compression bonding although other types of attachment methods are contemplated by this disclosure. In this way, a metallic cavity is formed around the microstrip 18. The metallic cavity under the center conductor (i.e., microstrip) offers a number of key characteristics to this line which makes it unique for sub-MMW and terahertz applications.

Figure 3A:
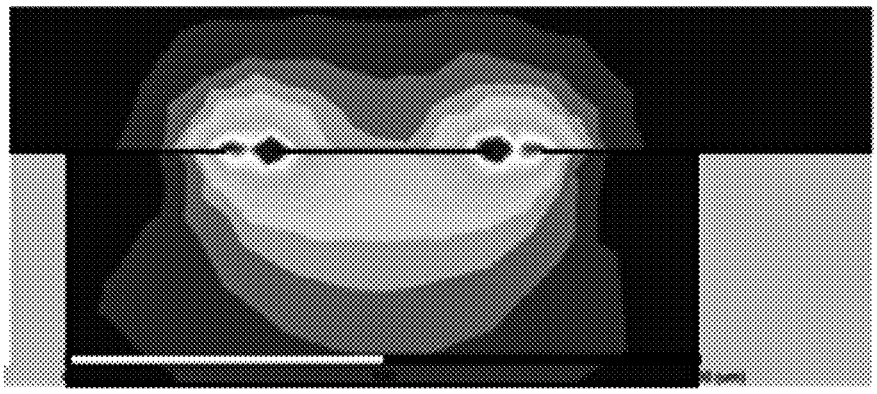
FIGS. 3A and 3B depict magnetic field distribution in (a) conventional 50-Ω CPW line on silicon substrate and (b) cavity-backed CPW line, respectively.
Figure 3B:
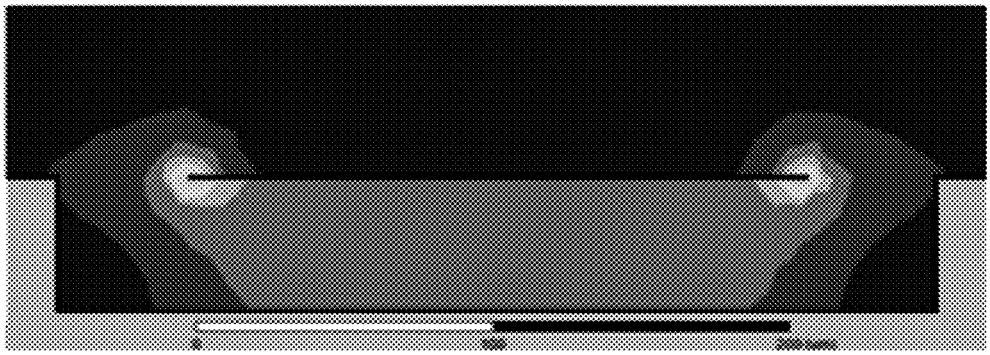

First, the ground on the bottom and sidewalls of the cavity result in a more uniform field and current distribution on both the center and the ground conductors, as shown in FIG. 3. This reduces the ohmic loss which is dominated by the currents concentrated on the edges of the center conductor and side ground strips.

Second, the presence of the side ground strips together with the lower ground trench creates a field distribution over the line cross section which is a hybrid of the conventional CPW and microstrip modes. This makes the transmission line versatile to benefit from advantages of both modes. The CPW mode allows for ease of integration of planar MMIC devices which is the main purpose of this design. On the other hand, the microstrip mode allows the design of the broadband transition from this line to the rectangular waveguides, as will be further described below.

Third, the cavity confines the field to the metallic box, eliminating substrate modes and any higher order modes which might be excited at the discontinuities.

Fourth, the added large capacitance between the cavity and the center conductor enables increase in the gap size between the center conductor and the side grounds while maintaining 50-Ω characteristic impedance which would eliminate the aforementioned problems with a small gap size.

Fifth, the lower trench also ensures excitation of the proper mode of operation at junctions and eliminates the need for the wire bridges commonly used in traditional CPW lines.

Figure 4:
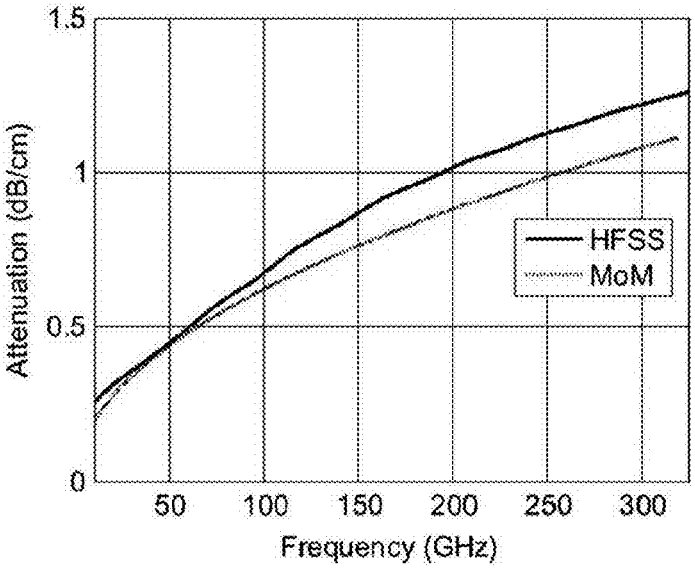
FIG. 4 is a graph depicting attenuation rate of the optimized CPCPW line using the MOM and HFSS simulations.

A 2-D MOM code was developed to calculate the current distribution ($J_s$) over the line and cavity and derive the conductor loss in the CPCPW structure based on the following equation:

$$\alpha = \frac{R_s}{2Z_c} \frac{\oint S_1 + S_2 |J_s|^2 dl}{(\oint S_1 |J_s| dl)^2} \tag{1}$$

where $R_s$ is the surface resistance $Z_c$ is the characteristic impedance of the line, and $s_1$ and $s_2$ are the cross section of the line and the ground (the cavity and the side grounds) respectively. The code is used to optimize the dimensions of the CBCPW line structure, namely the line width (s), gap size (g), and cavity height (h), to minimize the attenuation subject to $z_c$=50Ω. The width of the cavity (w) is limited to ensure suppression of higher order modes. In the example embodiment, the optimized dimensions are s=210 μm, g=45 μm, h=46 μm, w=300 μm. The optimized dimensions, however, may be generalized as follows. The height of the rectangular cuboid defining the trench is substantially same size as the gap separating the microstrip from the metal layer disposed on the top surface of the ground plane member, and the width of the rectangular cuboid defining the trench is substantially equal to the width of the microstrip plus two times width of the gap separating the microstrip from the metal layer disposed on the top surface of the ground plane member (i.e., w=s+2 g). The performance of the optimized structure was verified using a full-wave simulation (HFSS). The insertion loss of the optimized structure as a function of frequency is shown in FIG. 4.

Next, the configuration and the design procedure for developing a full-band transition from the cavity-back coplanar waveguide 10 to rectangular waveguide are presented. It is emphasized that the transition topology is chosen in such way that can be easily fabricated using silicon micromachining. To achieve a broadband response, an in-plane transition waveguide 50 is designed in three steps, as described below.

Figure 5A:
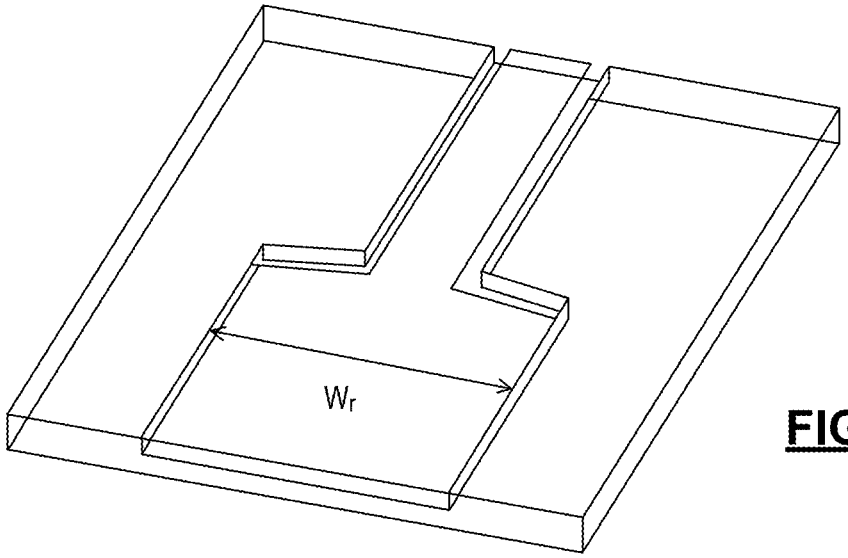
FIG. 5A is a diagram depicting a portion of an in-plane transition waveguide.
Figure 5B:
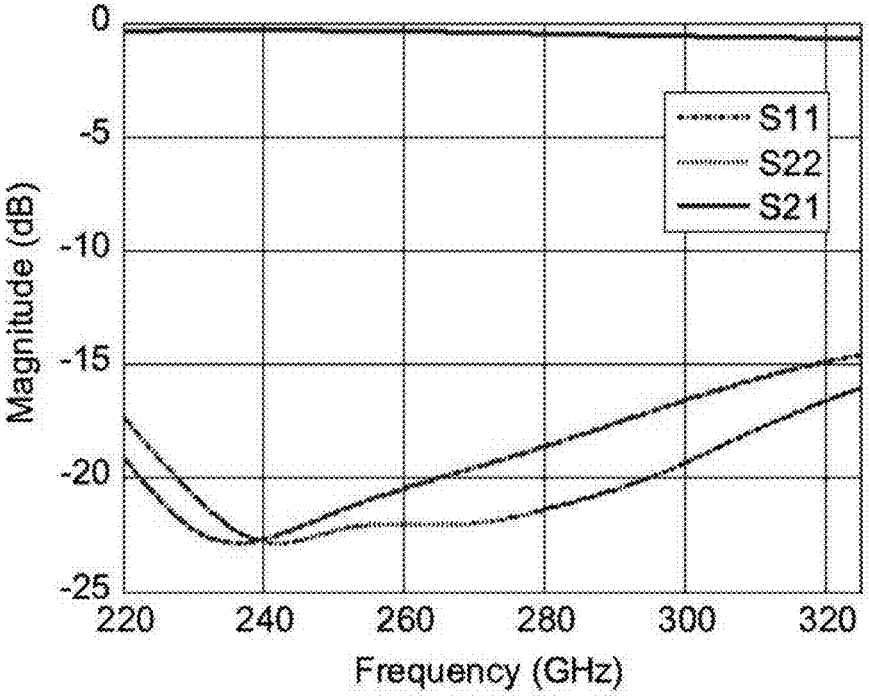
FIG. 5B is a graph illustrating full-wave analysis results for the portion of an in-plane transition waveguide shown in FIG. 5*a*.

In the first step, an input transition 51 is proposed from the cavity-backed coplanar waveguide 10 to a rectangular waveguide with the same height as the cavity (trench) height as seen in FIG. 5A. In this transition 51, the TEM mode on the cavity-backed coplanar waveguide 10 is converted to the $TE_{01}$ mode in the reduced-height waveguide. This transition is enabled due to the fact that the electric field distribution in the cavity-backed coplanar waveguide cavity resembles that of the $TE_{01}$ mode in waveguide. In addition, the width ($w_t$) of the reduced-height waveguide is tapered to achieve a perfect impedance match with the cavity-backed coplanar waveguide 10. In the example embodiment, the width ($w_t$) of the reduced-height waveguide is 800 μm. The transition dimensions are optimized for minimum insertion loss and maximum return loss. Full-wave analysis of the transition shows more than 15 dB return loss and less than 0.7 dB insertion loss over the entire band as seen in FIG. 5B.

Figure 6A:
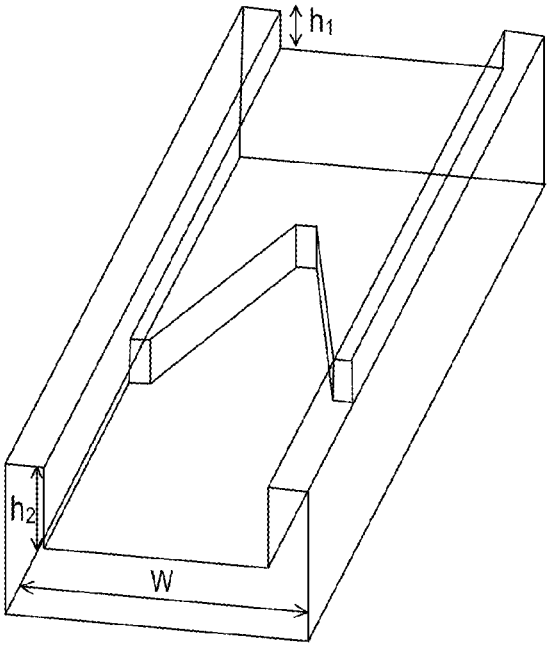
FIG. 6A is a diagram depicting a transition portion of the in-plane transition waveguide.
Figure 6B:
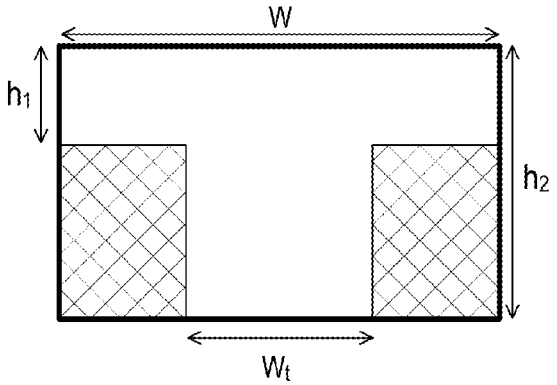
FIG. 6B is a cross-sectional view of the transition portion of the in-plane transition waveguide shown in FIG. 6A.
Figure 6C:
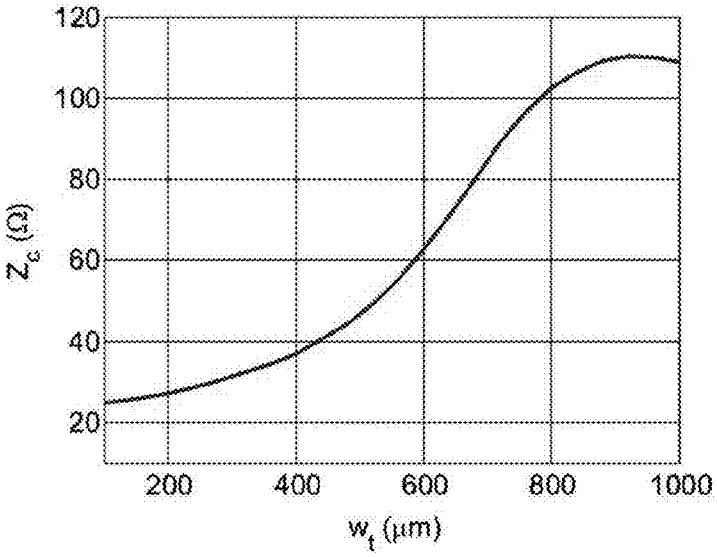
FIG. 6C is a graph illustrating the characteristic impedance versus width of the in-plane transition waveguide.

To get to the standard waveguide height (WR3), stepped transitions with an in-plane impedance taper is used in the in-plane transition waveguide 50. The standard approach to change waveguide height is to gradually taper the waveguide height, but this cannot be easily implemented. In an example embodiment, the in-plane transition waveguide 50 uses two height transitions to taper the impedance of the reduced-height waveguide 10 (50Ω) to the impedance of the standard WR3 waveguide (340Ω). Considering that a limited number of steps (i.e., preferably ≤3) can be realized using multi-step micromachining technique, the height of the waveguide cannot be tapered since the step discontinuities in the height of the waveguide (and the impedance) do not allow a wideband transition between the two waveguides. On the other hand, lithography process allows fabrication of in-plane features with fine features. Utilizing this characteristic, an in-plane wedge transition, as shown in FIG. 6A, is proposed to create the desired impedance taper. In this transition, the step heights between the waveguides ($h_1$, $h_2$) are tapered along the length of the in-plane transition waveguide 50. The cross-sectional view of the wedge transition is shown in FIG. 6B. Impedance analysis of this structure shows that the characteristic impedance ($Z_c$) smooth increases as $w_t$ increases as seen in FIG. 6C.

Figure 7A:
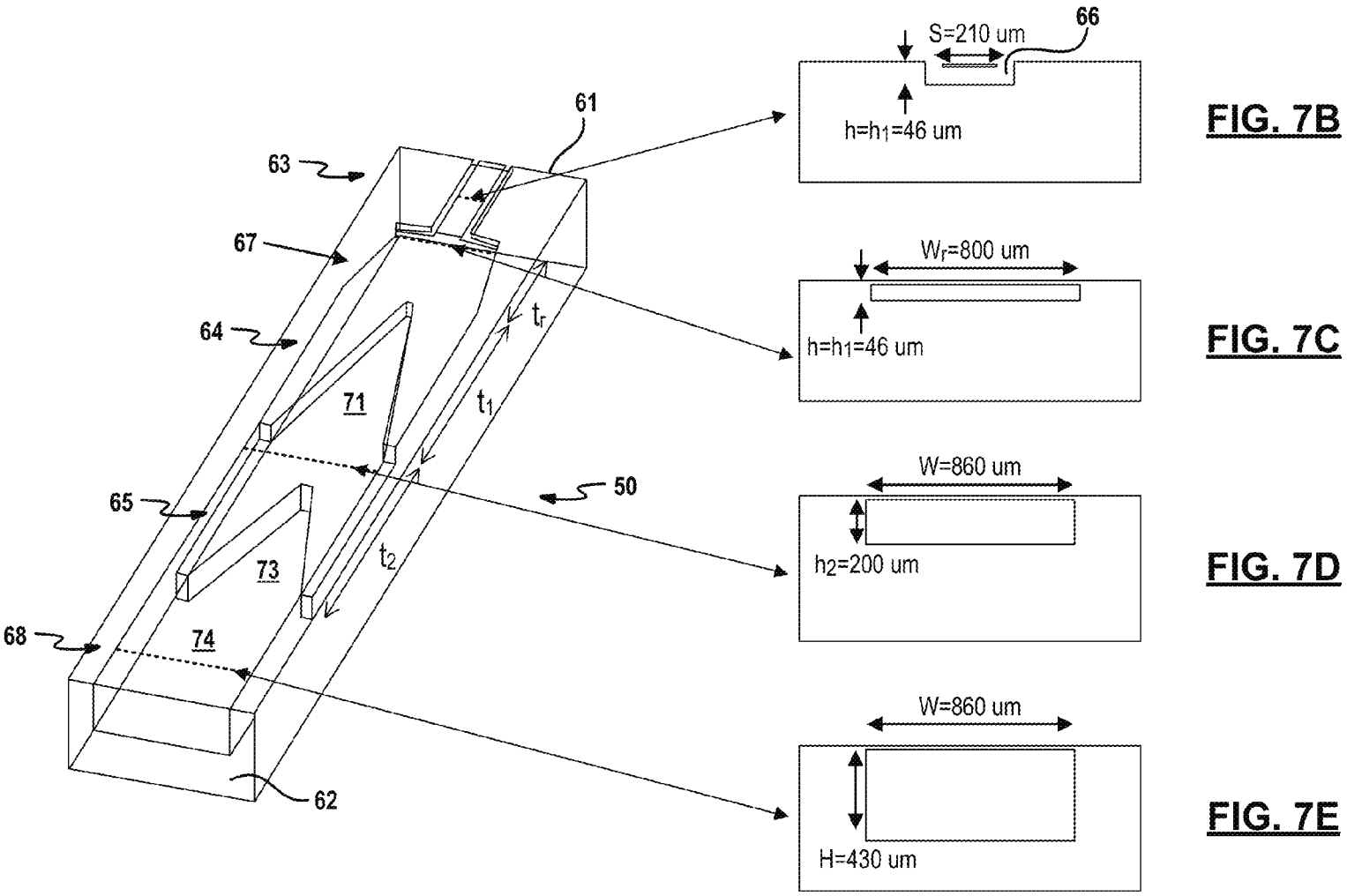

FIG. 7A depicts an example embodiment for the in-plane transition waveguide 50. The in-plane transition waveguide 50 defines an input side surface 61 and an output side surface 62 and includes an input transition waveguide section 63, a first v-shaped waveguide section 64, a second v-shaped waveguide section 65 and an output waveguide section 68. In this example embodiment, a three step transition is used: 1) from reduced width w=210 μm to $w_r$—800 μm; 2) from reduced-height waveguide ($h_1$—46 μm) to $h_2$—200 μm; and 3) from $h_2$=200 μm to $h_3$=430 μm. In other embodiments, it is understood that more or less steps may be employed.

The input transition waveguide section 63 serves as an input for the signal from the cavity-backed coplanar waveguide 10 and thus is configured to receive a signal propagating at a frequency in the millimeter-wave to terahertz range. In the example embodiment, an input trench 66 is formed in the top surface of the input transition waveguide section 63. Starting from a side end face, the input trench 66 is sized to correspond to the size of the trench in the cavity-backed coplanar waveguide 10 as seen in FIG. 7B but tapers outward in a tapered section 67 to a width that is equal to the width of the standard waveguide (WR3). In this example, the input trench 66 starts with a width on the order of 210 μm and tapers to a width on the order of 800 μm as seen in FIG. 7C. The height of the input trench 66 remains the same along its entire length (i.e., 46 μm). The input transition waveguide 61 is constructed in accordance with the waveguide described in FIG. 5A.

A first v-shaped waveguide section 64 is formed adjacent to and integral with the input transition waveguide section 61. The first v-shaped waveguide section 64 defines a planar top surface that is coplanar with bottom surface of the input trench 66. In the example embodiment, the planar top surface is 46 μm ($h_1$) below the top surface of the in-plane transition waveguide 50 as seen in FIG. 7C. The first v-shaped waveguide section 64 further includes a v-shape groove 71 formed in an end facing the output side surface 62, such that the v is parallel with the bottom surface of the in-plane transition waveguide 50 and the v opens towards the output side surface 62 of the in-plane transition waveguide 50. The groove forms a taper in the height of the waveguide. In additions to the v shape, other groove shapes with tapered edges can also be used.

Next, the second v-shaped waveguide section 65 is formed adjacent to and integral with the first v-shaped waveguide section 64. The second v-shaped waveguide section 66 defines a planar top surface that is recessed below the bottom surface of the input trench 66. In the example embodiment, the planar top surface is recessed 154 μm below the bottom surface of the input trench 66 which is 200 μm ($h_2$) below the top surface of the in-plane transition waveguide 50 as seen in FIG. 7D. The second v-shaped waveguide section 65 further includes a v-shape groove 73 formed in an end facing the output side surface 62, such that the v is parallel with the bottom surface of the in-plane transition waveguide 50 and the v opens towards the output side surface 62 of the in-plane transition waveguide 50.

Figure 8:
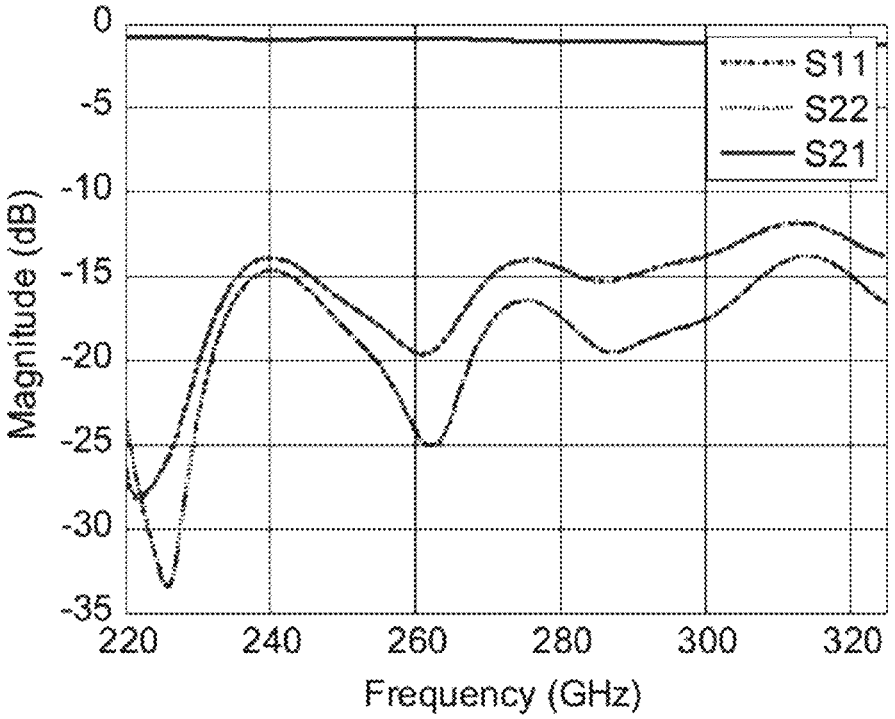
FIG. 8 is a graph illustrating full-wave analysis results for the in-plane transition waveguide shown in FIG. 7.

An output waveguide section 68 is formed adjacent to and integral with the second v-shaped waveguide section 65. In the example embodiment, the output waveguide section 68 also defines a channel 74 formed in the top surface of the output waveguide section 68. The channel 74 is sized to receive a standard size rectangular waveguide (WR3). For example, the channel has a height on the order of 430 μm and a width on the order of 860 μm as seen in FIG. 7E, where the height and width remain the same along the entire length of the output waveguide section 68. It is understood that these dimensions may vary for different applications. The length of the two v-shaped transitions ($t_1$, $t_2$) are optimized for maximum return loss over the band. Full-wave analysis of the transition shows less than 0.9 dB insertion loss and more than 13-dB return loss over the entire J-band as seen in FIG. 8. The return loss of the transition can be improved by increasing the taper length ($t_1$ and $t_2$) or adding more in-plane step transitions.

A major advantage of this in-plane transition waveguide 50 is that it can conveniently be scaled for terahertz applications. The processes used for the fabrication of the in-plane transition waveguide 50 offers sufficient accuracy, making the design and micro-fabrication method suitable for extension of the design to higher frequencies. For the example embodiment, the fabrication of the in-plane transition waveguide 50 is performed on two silicon wafers using micromachining technology as described. For the bottom wafer, the different recesses in each of the input transition waveguide section 63, a first v-shaped waveguide section 64, a second v-shaped waveguide section 65 and an output waveguide section 68 are micromachined on a silicon wafer (e.g., 1-mm-thick) using a multistep masking technique (bottom wafer). The multistep etching of the bottom wafer using DRIE technique creates significant roughness on the sidewalls of the etched structure. The roughness is caused by mask misalignment and the imperfections in the periodical etching and passivation of the DRIE process. This roughness can cause poor metallization in the gold deposition stage which results in high insertion loss in the micromachined structures. Oxidation of rough silicon surfaces has been successfully employed for smoothing. In the example embodiment, the surface is oxidized in the wet oxidation furnace at atmosphere pressure and 1100° C. temperature; it takes 9 h to reach 2 μm oxide thickness. The oxide layer is then stripped in HF. This process can be repeated to further smoothening of the sidewalls.

For the top wafer, a dielectric membrane is deposited on one side of a silicon wafer (e.g., 250 μm). In the example embodiment, the dielectric membrane is comprised of $SiO_2$—$Si_3N_4$—$SiO_2$ and deposited at a thickness of 1 μm although other types of non-conductive materials at varying thicknesses are contemplated by this disclosure. Prior to bonding, a metal layer (e.g., gold) is deposited onto both the top and bottom wafers. On the top wafer, metal is deposited and patterned such that the metal remains on those surfaces which contact with the bottom wafer; whereas, on the bottom wafer, metal is deposited entirely over the exposed top surfaces of the bottom wafer. The top and bottom wafers are then aligned and bonded together, for example using thermocompression bonding. It is understood that other types of attachment methods fall within the scope of this disclosure.

In another aspect of this disclosure, a novel waveguide probe measurement system is proposed and setup to evaluate the performance of the lines and transitions in the desired frequency band. In this technique, waveguide probes are used to perform full S-parameter characterization of the transitions. As mentioned earlier, measurement of S-parameters of micromachined on-wafer components is not straightforward. At lower frequencies (up to G-band), coaxial and coplanar waveguide (CPW) line ground-signal-ground (GSG) probes are commonly used for on-wafer S-parameter measurements. However, at frequencies above G-band the dimensions of the coaxial lines and the probe tips become too small to be mechanically stable. Larger size coaxial probes and probe lips lead to excitation of higher order modes in the line and radiation from the probe tips. Also the parasitics from the probe tips and the pads on the wafer lead to unreliable and non-repeatable measurements. Other measurement approaches are also reported in the literature. Although good performances have been reported, most of these approaches require complex structures and involve assembly of multiple parts with high level of accuracy. To overcome these problems and to be able to directly interface with micromachined waveguide components, an alternative approach based on using open-ended waveguide probes together with probe to on-wafer waveguide transition is investigated and the performance of the measurement technique is demonstrated at J-band.

Figure 9:
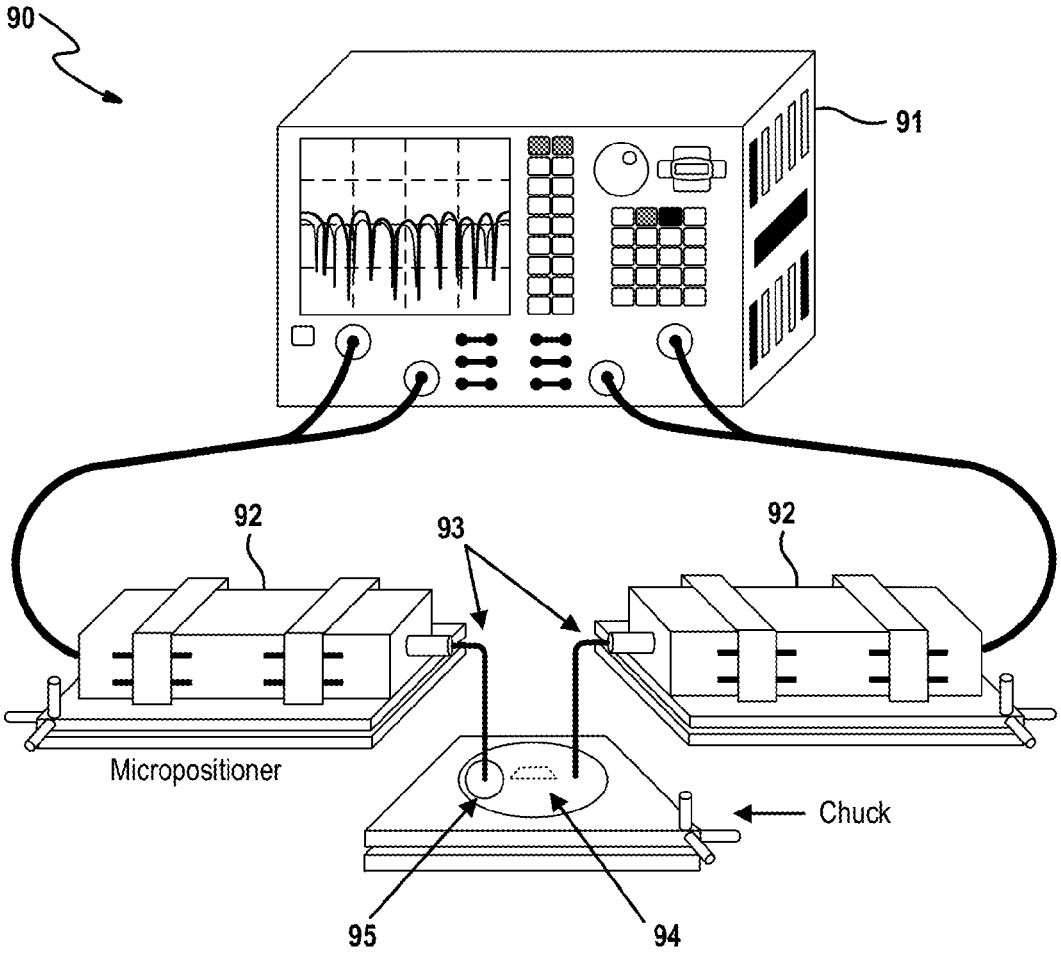
FIG. 9 is a schematic of a proposed measurement system showing the open-ended waveguide probes coupling the electromagnetic power to on-wafer waveguide components through proper micromachined transitions.

FIG. 9 shows a schematic of the proposed measurement system 90. The measurement system 90 includes a network analyzer 91, two frequency extending modules 92 and two open-ended waveguide probes 93 connected to the waveguide ports of the modules 92. The open ends of the probes 93 effectively couple the electromagnetic power to on-wafer waveguide components 94 through special waveguide transitions 95. The proposed transition is designed to be compatible with silicon micromachining technology and does not require assembly of multiple parts. Additionally, the waveguide probe and the transition are all rigid and immune to probe deformations resulting from wear and tear. In fact, the open-ended waveguide probe to the on-wafer waveguide transition can be non-contact. To facilitate this non-contact (imperfect contact) transition, an RF choke on the metallic wall of the waveguide cross section of the probe is created using electric discharge machining as further described below.

The proposed method for measurement of the S-parameters of on-wafer waveguide components 94 is based on connecting special open-ended waveguide probes 93, which are connected to the two ports of frequency extenders 92 of a network analyzer 91, to on-wafer micromachined waveguides through proper E-plane bend transitions 95. Due to limitation of microfabrication process, a stepped transition 95 is considered as seen in FIGS. 10A-10C. The width of the micromachined waveguide 102 inside the lower silicon wafer 103 can also easily be changed to a desired width depending on the band of operation and the requirement on the loss. The width tapered transition 103 can easily be facilitated by micromachining. In the example embodiment, the stepped transition 95 is comprised of three steps having the following dimensions: $d_1$—184 μm, $h_1$—118 μm, $d_2$=109 μm, $h_2$—182 μm. The number of steps, their widths and heights may vary depending on the application but are calculated using a full-wave solver through an optimization process for maximum power coupling.

In an example embodiment, the waveguide top 104 is covered by a second silicon wafer patterned by a thin dielectric membrane and metalized on one side. This wafer is attached to the lower wafer using gold-to-gold thermo-compression bonding. To align the opening of the waveguide probe 93 with that of the on-wafer waveguide 102, a rectangular window 105 with dimensions slightly larger than those of the outer dimensions of the waveguide probe 93 is micromachined on the top wafer 104. The open-ended waveguide probe 93 can be inserted in the window 105 allowing alignment resolution of less than 10 μm (2% of waveguides dimensions), as illustrated in FIG. 11. It should be mentioned that the membrane and the metal layer have rectangular opening exactly the same size as that of the open-ended probe. The dielectric membrane maintains the current distribution over the top wall of the waveguide and a minimum gap between the waveguide probe and the surface of the on-wafer waveguide at the transition point.

Full-wave analysis of the proposed structure was performed in a commercial Finite Element Method solver (Ansoft HFSS). FIG. 12 shows the simulation results of the optimized J-band two-step transition. The metal loss is not included in this simulation and it is assumed that the waveguide probe and the on-wafer waveguide are physically connected with no misalignments. The result shows that the transition has a reflection loss of more than 30 dB with an insertion loss of less than 0.01 dB over the entire J-band (220-325 GHz).

When a waveguide is cut by machine tools, the surface of the cut area becomes rough with a roughness on the order of few micrometers, and the cross section may not be exactly perpendicular to the waveguide axis. As a result, a good contact between the waveguide probe and the waveguide opening cannot be established. Also, as seen at 107 in FIG. 10B, a thin metal coated dielectric membrane exists between the waveguide probe and the top of the on-wafer waveguide transition. This imperfection can result in high reflection and radiation loss through the gap. The uncertainty about the gap formation between the probe and the transition will adversely affect the measurement repeatability as well.

To circumvent these difficulties, one approach is to make a waveguide choke as seen in FIGS. 13A and 13B. A waveguide choke presents a very low series impedance at the junction independent of the gap value around the junction edge. However, the difficulty at SMMW band is the fabrication of the choke itself due to its small dimensions. At these frequencies the waveguide walls are thick enough to support the choke structure. In the example embodiment, the choke design includes a circular stub 131 with the depth of approximately quarter-wavelength connected to a recessed circular disc 133 around the waveguide opening. It is understood that the choke may employ a different geometry and/or dimensions depending on the interface. Full-wave analysis of the probe coupling to the on-wafer waveguide is performed for different gaps between the probe cross section and the wafer surface. As shown in FIG. 14, the insertion loss for an 80 μm gap between the surfaces is more than 1 dB for probe without the choke and it reduces to less than 0.2 dB for the probe with the choke. This shows that the presence of the choke reduces the sensitivity of the measurements to the contact quality significantly. The design parameters are optimized to minimize the return loss in the desired band (230-270 GHz).

Grooves are milled using an electrical discharge machining (EDM) technique to fabricate the choke with a high level of accuracy. The choke dimensions can also be optimized for bestfull-band (220-325 GHz) performance. FIG. 15 shows the coupling performance from the probe with a full-band choke to the on-wafer waveguide for different gaps between the probe cross section and the wafer surface.

In the example embodiment, the fabrication of the waveguide transitions 95 is based on the micro-fabrication process described in M. Vahidpour and K. Sarabandi, "2.5 D micromachined 240 GHz cavity backed coplanar waveguide to rectangular waveguide transition", IEEE Tran. Thz Sci. Technol., vol. 2, no. 3, pp. 315-322, May, 2012. That is, two separate silicon wafers, referred to as top and bottom wafers, are used for fabrication. The bottom wafer has a thickness of 1 mm and consists of the stepped transitions and the waveguide trenches which are fabricated using the multi-step patterning and etching process. The process includes patterning the wafer with two layers of oxide and one layer of photo-resist, and etching each step using the deep reactive ion etching (DRIE) technique. The top wafer, which has a thickness of 250 μm, supports a 1 μm thick deposited $SiO_2$—$Si_3N_4$—$SiO_2$ dielectric membrane that forms the top wall of the waveguide. Additionally, a rectangular opening (window) with dimensions slightly larger than the outer dimensions of the waveguide probe is etched on the top wafer for ease of probe alignment. Once the top and bottom wafers are fabricated, gold is deposited on the wafers and the two wafers are bonded to each other, for example using gold-to-gold thermo-compression bonding. The gold on the top wafer is patterned and removed to create the waveguide aperture over the E-plane bend transition 95.

A scanning electronic microscope (SEM) image of a two-step transition reveals that columns of silicon are formed as stalagmites at the edges of the steps which deteriorate the performance of the transition. These stalagmites are formed as a result of the passivation layer deposited on the vertical walls of the steps during the DRIE process. The role of this passivation layer is to create a directional etch by preserving the side walls of the trench from the ion bombardment in the Bosch etching process. Once this passivation layer is formed on the vertical wall of a step, it creates a barrier in etch of the subsequent step and hence the stalagmites are made at the edge of the steps.

In order to remove the stalagmites, a technique based on isotropic etch of the silicon is developed. In this technique the silicon stalagmites are isotopically etched by exposing the sample to Xenon Difluoride ($XeF_2$) for 60 s. Since the stalagmites are very thin (less than 10 μm in thickness), the isotropic etch attacks the silicon columns from all directions while leaving minimal effects on the rest of the structure. Prior to the etch, the surface of the silicon is cleaned from the passivation layer deposited in the DRIE process as well as the inherent silicon dioxide ($SiO_2$) formed on the surface of the silicon, by soaking the sample in Hydrofluoric Acid (HF) for 10 min. It is noted that the etch needs to be performed no later than 20 min after the cleaning process, before allowing a layer of $SiO_2$ to be formed on the surface of the wafer. The effectiveness of this method is shown in a SEM picture of the steps after performing the $XeF_2$ technique. An alternative approach for removing the stalagmites is based on oxidization of silicon and stripping the $SiO_2$ layer in HF, a technique that is employed for smoothing rough silicon surfaces.

Perfect alignment of the waveguide probe with the waveguide openings is very challenging and without a reliable method it can be the major error source in measurements. In this approach, the provision of an opening on the top wafer restricts the possible sources of misalignment (rotation and lateral displacement) significantly. As mentioned earlier, this window limits the probe positioning error to a maximum of 10 μm. In addition to the measurement errors, the micromachining of the transition with multiple fabrication steps is prone to some errors. Errors caused by DRIE etching and small misalignments between the top and bottom wafers can degrade the performance of the transition to some extent. DRIE etch of the steps with the exact height over a large area is rather difficult if not impossible. The position of the sample inside the etching chamber, the temperature of the chamber, the depth of etch, etc. vary the etch rate from one etch to another. For the proposed transition fabrication, a maximum error of 20 μm can be encountered.

To investigate the effects of probe positioning and microfabrication errors on the performance of the transition, full-wave simulations are carried out. FIG. 16 illustrates how minor probe misalignments affect the performance of the transition. FIG. 17 represents how step height variations affect the insertion and reflection coefficients of the transition, showing maximum insertion loss of 0.2 dB for all possible height variations of the steps.

Another source of error pertains to the milling of the choke on the waveguide probes. The EDM technique has a high precision tolerance of within 2 μm that has negligible effect on the choke performance. But the displacement between the centers of the milled choke and the waveguide can degenerate the performance of the choke in presence of a gap. FIG. 18 shows the effect of this displacement in the performance of the transition, showing minimal deviation from the aligned milled choke.

The performance of the on-wafer E-bend stepped transition with probe alignment window and the waveguide probe with the RF choke is measured using the following setup. An Agilent N5245 4-port network analyzer is used along with OML MMW frequency extending modules to perform full 2-port S-parameter measurement at J-band. The two waveguide probes are connected to the output ports of the frequency extending modules from one end and connected to the openings of the on-wafer waveguides from the other end. The measurement setup is calibrated up to the output ports of the frequency extenders. FIG. 19 illustrates the measured return loss and insertion loss of a back-to-back transition with a waveguide segment of 4.8 mm in between. For a fair evaluation of the transition, the insertion loss of the 10 cm long probes is removed from the measurements and the remainder is presented, representing the insertion loss of the back-to-back transition only. This is based on the assumption that the reflections from the connections of the probes to the modules and the on-wafer openings are negligible. The loss of the waveguide probes is estimated by short-circuiting the probes with a 1 μm gold coated wafer and measuring the reflection coefficient of the short-circuited probes. The results show that the back-to-back waveguide to on-wafer micro-machined transition has an insertion loss of less than 0.7 dB over the entire J-band.

As shown above, the misalignment of the probe with respect to the on-wafer waveguide opening as well as the gap between the probe and the wafer's surface will affect the performance of the measurements. To investigate the effect of these errors on uncertainty of the measurements, a repeatability test is carried out. In this test, 30 repeated measurements of the same back-to-back transition were taken over a 2 h span where in each measurement the probes were removed and then re-inserted into the openings after repositioning them. The transmission coefficients of the measurements are illustrated in FIG. 20A. For a more clear comparison of the measurements, the measured transmission coefficients are normalized to a single measurement and represented in FIG. 20B, where it shows a repeatability error of less than 0.2 dB in the measurement of the transmission coefficient of a single back-to-back transition over the entire frequency range.

Characterization of multiport components, such as directional couplers, hybrids, and power splitters, using two-port measurement systems require independent measurements of pairs of ports one at a time while all of the other ports are terminated with matched loads. Since matched loads are usually integrated with the device, identical devices must be fabricated with different ports terminated with matched loads in order to complete the S-parameter measurements. Thin-film resistors are typically used as on-wafer loads to terminate the desired ports. Performance of thin-film resistors, however, degrades rapidly as the frequency is increased due to parasitic effects, thus limiting their application to low frequencies below 60 GHz.

In another aspect of this disclosure, a novel S-parameter measurement method for characterization of on-wafer multiport devices and components is developed to circumvent the aforementioned difficulties associated with high-frequency device measurements. The proposed method requires a two-port vector network analyzer (VNA) with the ability to perform S-parameter measurements in the desired frequency band. The schematic of the proposed method is shown in FIG. 21. The input port (port 1) of the multipart device is fed with port 1 of the variable network analyzer (VNA). The input power at port 1 and the output power at port 2 of the VNA through as coupling mechanism using an open-ended waveguide. Identical rectangular slots are fabricated over the micromachined waveguides to couple a small fraction of the input/output power at each port. A waveguide probe is used to measure the amplitude and phase of the coupled signal from the slots at all ports including port 1. All of the output ports are terminated with on-wafer micromachined loads to avoid reflections. The S-parameters of the device can then be calculated using the measured signals collected by the waveguide probe.

To characterize an N-port device, the complete scattering matrix ($S_{mn}$,m,n∈{1, . . . , N}) of the N-portdevice must be measured using a two-port VNA. In the conventional method, N(N−1)2 device test configurations must be arranged with a two-port VNA in order to fully characterize the scattering matrix. In each configuration, two ports of the device are connected to the VNA and the rest are terminated with matched loads. For symmetric devices (e.g., directional couplers), the device can be fully characterized by measuring a single column of the scattering matrix. This requires measuring N−1 different device configurations using the conventional method.

In the proposed technique, a single column of the scattering matrix i.e., ($S_{m1}$,m∈{1, . . . , N}) of an N-port device can be retried based on N noncontact VNA transmission ($S_{21}^{VNA}$) measurement for a single-device measurement configuration (See FIG. 1) plus a reference noncontact measurement of the input (port 1) structure which is terminated with a matched load. The input port can be excited using any method (GSG probe or waveguide connection). This way the response of the excitation method (return loss and insertion loss of the input transition) can be removed from the S-paramater measurements.

The circuit model for the proposed N-port device measurement and the reference measurement are shown in FIG. 22. As mentioned before, a number of small rectangular slots on the broad wall of micromachined waveguides are used as a coupling mechanism. The rectangular slots over the waveguides at each port are modeled as transformers that couple a very small portion of energy to the free space (n>>1, δ<<1). Here, n refers to the turn ratio of the transformer and δ is the ratio of the coupled signal outside through the slot to the input signal inside the waveguide. The coupled signal is proportional to the total signal in the waveguide at the slot location. It is important that these slots be designed in such away as to minimize the reflection in the waveguide (<−20 dB). The outputs of the other ports are terminated with matched load $Z_0$ to ensure $$a_m \cong 0, m \neq 1 \tag{1}$$

where $a_m$ is the incident voltage wave to port m(m∈{1, . . . , N}).

The measured signal at port 2 of the VNA is the coupled signal from the slots to a near-field waveguide probe at an exact height and lateral position with respect to the slots at each port. The coupling to the waveguide probe is also modeled with a transformer. Thus, the measured $S_{21}$ of the network analyzer for each port of the N-port device can be written as $$S_{21,1}^{VNA} = \frac{c\delta(a_1 + b_1)}{a_1} \tag{2a}$$

$$S_{21,m}^{VNA} = \frac{c\delta b_m}{a_1}, m \neq 1 \tag{2b}$$

where $b_m$ is the reflected voltage wave from port m and c is the coupling factor to the near-field waveguide probe (m∈{1, . . . , N}).

In the measurement configuration shown in FIG. 22B, the input port is terminated with matched load $Z_0$ and hence $$b_1 \cong 0 \tag{3}$$

for the reference waveguide transition. Since the excitation method and the position of the slots are identical to the input port of the N-port device, the measured $S_{21}$ of the reference waveguide transition is equal to $$S_{21,ref}^{VNA} = \frac{c\delta(a_1 + b_1)}{a_1} \cong c\delta. \tag{4}$$

The coupling coefficient cδ is a complex number which is equal for all of the measurements since the slots positions are at the reference planes (designated port location) and the probe position are kept identical with respect to the slots.

The input power to the device is the input power from port 1 of the VNA minus the power radiated by the slot ($ka_1$). Referring to FIG. 22A, k represents the ratio of the input signal to the device to the input signal to the port (k≅1). Hence, the S-parameters of the device are defined as $$S_{m1}^{D} = \frac{b_m}{ka_1}, m = 1, \ldots, N. \tag{5}$$

From (2a) and (4), the return loss of the device is computed from $$S_{11}^{D} = \frac{b_1}{ka_1} = \frac{1}{k}\frac{S_{21,1}^{VNA} - S_{21,ref}^{VNA}}{S_{21,ref}^{VNA}} \tag{6}$$

Also, from (3b) and (4), the rest of the $S_{m1}$ parameters of the device are found to be $$S_{m1}^{D} = \frac{b_m}{ka_1} = \frac{1}{k}\frac{S_{21,m}^{VNA}}{S_{21,ref}^{VNA}}. \tag{7}$$

As indicated by (6) and (7), the S-parameters of the device can be derived from the VNA transmission measurements and parameter k. It will be shown later that the coupled power to the coupling slots is very small over most of the band (k≅1). For a better estimation of the S-parameters, the simulated value of k will be used in (6) and (7).

For a nonsymmetric N-port device, only N−1 other device configurations are required where the nth port is connected to the input of the VNA and the rest of the ports are terminated with matched loads. This is by a factor (N−1)/2 smaller than the conventional method that requires N(N−1)/2 device configuration measurements.

As will be shown later, the proposed matched load for port terminations has a finite return loss over the entire band (down to 22 dB at some frequencies) which can cause errors in the calculated device S-parameters. By including the reflected signal from each port back to the DUT in (6) and (7), the S-parameters of the DUT are found to be $$S_{11}^{D} = \frac{1}{k}\frac{S_{21,1}^{VNA} - S_{21,ref}^{VNA}}{S_{21,ref}^{VNA}} + \Gamma_l\left(\frac{S_{21,1}^{VNA}}{S_{21,ref}^{VNA}} - \sum_{n\neq 1} S_{n1}^{D} S_{1n}^{D}\right) + O(\Gamma_l) \tag{8}$$

$$S_{m1}^{D} = \frac{1}{k}\frac{S_{21,m}^{VNA}}{S_{21,ref}^{VNA}} - \frac{\Gamma_l}{1 + k\Gamma_l}\sum_{n\neq 1,m} S_{n1}^{D} S_{mn}^{D} + O(\Gamma_l^2), m \neq 1 \tag{9}$$

where $\Gamma_l$ is the reflection coefficient of the matched load. The nonlinear equation above cannot be solved analytically to find $S_{m1}^{D}$. However, the coupled equations can easily be solved iteratively using the perturbation method noting that the load mismatch is a small quantity. The first-order solution is obtained by assuming all the loads are perfect. It can be shown that, in the worst case scenario, the uncertainty in the calculated S-parameters is $\Gamma_l$. Once the first-order solutions are obtained, then one can use the first-order solution in the exact equations with the actual load impedance values (from simulations) to find the second-order solution. This way, one can solve the nonlinear equations and the errors will be of the order $T_l^2$ (~44 dB). This process can be continued to any desired order of accuracy.

Here the design and analysis of the slot array and the probe measurement configuration for the J-band (220-325 GHz) is presented. It is known that electromagnetic energy may be coupled to free space by creating small apertures at suitable location on a waveguide. However, the insertion of slotapertures also creates reflection in the waveguide. This reflection can cause error in the calculations. To solve this problem, array of small slots are designed as shown in FIG. 23A. The size of the array is optimized to achieve maximum reflection cancellation from individual apertures and minimize the total reflected power. The optimized coupling slot array is composed of 14 closely spaced small slots occupying an area of 555 μm×300 μm (0.5λ×0.27λ at 272 GHz). Full-wave analysis of the optimized design shows more than 20-dB return loss over the entire J-band. The transmitted power through the waveguide is more than 99% of the input power at 220 GHz and drops to 85% at 325 GHz.

An example noncontact measurement setup is shown in FIG. 24A. The input port is excited with a waveguide bend that is connected to port 1 of the VNA through an appropriate frequency extender. An E-plane bend transition (as described above) is designed and optimized to create a broadband impedance match between the vertical waveguide probe and the horizontal micromachined waveguide. The signal coupled from the waveguide through the slotarray is measured with the near-field probe which is connected to the port 2 of the network analyzer through another frequency extender. The probe position can be precisely manipulated in all three directions with a micropositioner. Full-wave analysis of the slot array in presence of the near-field waveguide probe is performed in a commercial finite-element solver ANSYS HFSS. The simulated structure is shown in FIG. 24B. The structure is placed within a box having the radiation boundary condition at its surface, and the three waveguide ports in the figure are excited using waveports. The probe is positioned at a short vertical distance (e.g., 300 μm) over the slot array. It should be noted that the exact height of the probe does not affect the calculated S-parameters as long as it is fixed for all of the measurements. The probe position is adjusted precisely in the horizontal plane to maximize the coupled power to the probe. This would result in identical probe positions with respect to the slots assuming that the reflected power at each port is very small. FIGS. 25A-25C shows the reflected, transmitted, and coupled power, respectively, versus the position of the waveguide probe in the horizontal plane with respect to the center of the slotarray. The return loss in the waveguide is more than 25 dB and the transmission into the waveguide varies by less than 0.1 dB for all probe positions in the 2×2 $mm^2$ area around the slot array. This ensures that the presence of the probe does not perturb the measured characteristics of the DUT. The maximum coupling ($S_{31}$) is achieved when the probe is located at (0, 200 μm) with a power coupling factor of about −12 dB. The offset in the y-direction is expected since the radiation beam of the traveling-wave slot array is tilted towards the +y direction. The coupling drops rapidly in all directions as the probe mows away from the maximum coupling position. The coupling drops down to below −25 dB when the probe is outside 1-mm radius of the slot array. This ensures that, if the slot arrays are sufficiently far from each other, the radiated power from the other ports do not couple to the probe over a given port and cause measurement errors.

As mentioned earlier, the output ports of the multi port device must be terminated with good loads having a very low reflection in order for the proposed measurement approach to work properly. A radiating load is the easiest to implement in terms of bandwidth, lack of parasitics, and compatibility to micro-fabrication. Here, a traveling-wave slot array over the broad wall of the waveguide is considered for terminating the ports. To achieve a broadband response over the entire J-band, the array is implemented in multiple sections. The first section is an array of small slots that shows a good return loss at higher end of the band. In the following sections the length of the slots ($l_s$) is increased gradually to increase the radiated power by the slots at lower frequencies while maintaining a high return loss over the band. Finally, the last section is composed of two very large slots which radiate the remaining power in the waveguide. The dimensions of the slots and length of the array are optimized to achieve the maximum return loss for the minimum length of the array over the full band. Full-wave analysis shows the optimized load has more than 22-dB return loss over the entire J-band as shown in FIG. 26. In this implementation, the length of the antenna is 11.1 mm.

To evaluate the accuracy and usefulness of the proposed measurement method, four-port directional couplers with different coupling factors and bandwidth are designed, micromachined, and tested as multiport components. Waveguide directional couplers are of interest for sub-MMW and terahertz applications due to their low loss and simplicity of integration with other micromachined components. In these couplers, the coupling is achieved through apertures on the common wall between the two adjacent waveguides. The multistep etching process allows realization of multiple apertures with arbitrary heights along the common wall between two adjacent waveguides. Multiple-aperture couplers have been extensively studied in the past. Following the design procedure for non-uniform aperture arrays, different directional couplers with different bandwidths and coupling coefficients are designed. These designs are then optimized using full-wave simulations. FIGS. 27A-27C show the optimized design of three different couplers: 1) 10-dB coupler (230-245 GHz); 2) 10-dB coupler (220-325 GHz); and 3) 3-dB coupler (220-325 GHz). To characterize these couplers using the proposed measurement method, the output ports of the couplers (through, coupled, and isolated) are terminated with the matched load. The radiating slots on each port are separated by more than 5 mm to ensure little coupling between the coupling slots and the radiating loads. The input port is connected to an E-plane transition to enable excitation of this port using a waveguide probe as was described above. FIG. 28 shows the schematic of the test configuration implementation. The input structure for the coupler and the reference waveguide are designed identical to enable calculation of the S-parameters of the couplers using (6) and (7).

The couplers and the slot array waveguides are fabricated using two silicon wafer micromachining process. The coupler structure and the waveguides are realized on the bottom wafer using a multistep DRIE etching process. The slot array pattern is realized on the top wafer on thin membrane. Lift-off technique is used for pattering gold on top wafer to obtain the high precision required for the coupling slot array features. The two wafers are then bonded to form the complete structure shown in FIG. 28 using gold-gold thermos-compression bonding. The two wafers are aligned using a bond aligner tool with alignment errors below 5 μm. This alignment accuracy is sufficient for this application given the dimensions of the waveguide structure.

The probe measurement setup is as follows. A two-port J-band measurement system is utilized to perform full two-port S-parameters. The system is calibrated using WR-3 TRL calibration kit up to the output ports of the frequency extenders. The J-band frequency extenders of the VNA are mounted over the precision positioners to enable accurate positioning of the waveguide probes as shown in FIG. 24A. The waveguide bend is connected to the waveguide port of one of the frequency extenders (port 1) to excite the device through the E-plane bend transition fabricated inside the silicon wafer. An open-ended waveguide probe is connected to the part of the other frequency extender to measure the signal from the coupling slots. The open end of the probe is tapered to minimize the reflections at the probe cross section. The location of this probe over the slot arrays is obtained by adjusting its position until a maximum signal is measured by the network analyzer. It should be mentioned that the height of the waveguide probe with respect to the substrate is fixed while the probe is moved in the horizontal plane to measure different ports of the couplers. Hence, the error in the height is very small (less than 10 μm). Simulations show that this error in height changes the coupling factor to the probe by less than 0.2%. The measured and simulated characteristics of the three fabricated couplers are shown in FIG. 29A-29C. The difference between the simulated and measured results, especially for the weak $S_{11}$ and $S_{41}$ signals, are due to the nonideal matched loads and the finite reflection from the coupling slot. The measured return losses of the couplers are shown in FIG. 30. Repeating the experiment multiple times, it is noticed that the measurements are highly reliable and repeatable.

A noncontact S-parameter measurement method for characterization of on-wafer multiport devices using a two-port VNA is presented. The proposed method is based on sampling the magnitude and phase of the signal at each port. In this method, a small fraction of the signal at each port is coupled to free space using an array of reflection canceling slots and measured using an open-ended waveguide probe. It is shown that the S-parameters of the device under test can be calculated using the measured signals at each port. A broadband waveguide slot array antenna with good return loss is utilized as the matched load to terminate all ports except the input port of the device. To evaluate the proposed measurement method, micromachined waveguide directional couplers are designed and fabricated. Multiple apertures on the common wall between the adjacent waveguides are designed and optimized to achieve high directivity couplers over a broad frequency range. The measured results are in good agreement with the simulations which indicates the accuracy of the proposed measurement method. It is shown that the proposed S-parameter measurement approach for sub-MMW is accurate, repeatable, far easier and faster than the conventional method.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers maybe present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms maybe only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. An in-plane transition waveguide for interconnecting a standard sized rectangular waveguide with a reduced height waveguide having a height less than the height of the standard sized rectangular waveguide, comprising:

a substrate defining a longitudinal axis with an input side surface and an output side surface at opposing ends of the longitudinal axis;

an input transition section having a trench formed into a top surface of the substrate, where the trench projects inward from the input side surface of the substrate and is configured to receive a signal with a frequency in millimeter to terahertz range;

a first waveguide section formed on the substrate adjacent to and integral with the input transition waveguide section, the first waveguide section having a channel formed in the top surface of the substrate, where the channel defines a planar bottom surface that is coplanar with bottom surface of the trench, the first waveguide section having a v-shape groove formed in an end of the first waveguide section that is facing the output side surface, such that the v is parallel with bottom surface of the trench and the v opens towards the output side surface of the substrate;

a second waveguide section formed on the substrate adjacent to and integral with the first waveguide section, the second waveguide section having a channel formed in the top surface of the substrate, wherein the channel defines a planar bottom surface that is recessed below the planar bottom surface of the channel in the first waveguide section, the second planar section having a v-shape groove formed in an end of the second waveguide section facing the output side surface, such that the v is parallel with bottom surface of the trench and the v opens towards the output side surface of the substrate; and an output waveguide section formed in the substrate adjacent to and integral with the second waveguide section, the output waveguide section having a channel formed in the top surface of the substrate and extending from the second waveguide section to the output side surface of the substrate, wherein the channel is sized to receive a rectangular waveguide.

2. The in-plane transition waveguide of claim 1 wherein a rigid metal-coated dielectric membrane is deposited over top the in-plane transition waveguide.

3. The in-plane transition waveguide of claim 2 wherein a metal is deposited onto top exposed surface of the in-plane transition waveguide prior to depositing the rigid metal-coated dielectric membrane.

4. The in-plane transition waveguide of claim 3 wherein the trench includes a first section and a second section, wherein the first section of the trench is adjacent to the input side surface and has a width smaller than the width of the channel in the first waveguide section, and the second section of the trench tapers from width of the first section to a width that is substantially the same as the width of the channel in the first waveguide section.

5. The in-plane transition waveguide of claim 4 wherein height of the channel in the output waveguide section is equal to height of a standard size rectangular waveguide.

6. The in-plane transition waveguide of claim 1 is interfaced with a cavity-back coplanar waveguide, wherein the cavity-back coplanar waveguide includes a ground plane member having a trench formed in a top surface thereof, the trench having a longitudinal axis and extending from one side of the ground plane member to an opposing side of the ground plane member;

a metal layer disposed on and substantially covering the top surface of the ground plane member, including covering walls forming the trench;

a dielectric membrane; and a microstrip formed on the dielectric membrane and configured to propagate a signal with a frequency in millimeter to terahertz range, wherein the dielectric membrane attaches to the top surface of the ground plane member, such that the longitudinal axis of the microstrip aligns with the longitudinal axis of the trench, and the microstrip is suspended in and spatially separated from walls of the trench.

7. The in-plane transition waveguide of claim 6 wherein height and width of the trench in the input transition section are substantially same as corresponding height and width of the trench in the cavity-back coplanar waveguide.

8. An apparatus for propagating signals with a frequency in millimeter to terahertz range, comprising:

a cavity-backed coplanar waveguide, the cavity-backed waveguide includes:

a ground plane member having a trench formed in a top surface thereof, the trench having a longitudinal axis and extending from one side of the ground plane member to an opposing side of the ground plane member;

a metal layer disposed on and substantially covering the top surface of the ground plane member, including covering walls forming the trench;

a dielectric membrane; and a microstrip formed on the dielectric membrane and configured to propagate a signal with a frequency in millimeter to terahertz range, wherein the dielectric membrane attaches to the top surface of the ground plane member, such that the longitudinal axis of the microstrip aligns with the longitudinal axis of the trench, and the microstrip is suspended in and spatially separated from walls of the trench; and an in-plane transition waveguide electrically coupled to the cavity-backed coplanar waveguide and configured to interconnect the cavity-backed coplanar waveguide to a standard sized rectangular waveguide, wherein the in-plane transition waveguide further comprises a substrate defining a longitudinal axis with an input side surface and an output side surface at opposing ends of the longitudinal axis;

an input transition section having a trench formed into a top surface of the substrate, where the trench projects inward from the input side surface of the substrate and is configured to receive a signal with a frequency in millimeter to terahertz range;

a first waveguide section formed on the substrate adjacent to and integral with the input transition waveguide section, the first waveguide section having a channel formed in the top surface of the substrate, where the channel defines a planar bottom surface that is coplanar with bottom surface of the trench, the first waveguide section having a v-shape groove formed in an end of the first waveguide section that is facing the output side surface, such that the v is parallel with bottom surface of the trench and the v opens towards the output side surface of the substrate;

a second waveguide section formed on the substrate adjacent to and integral with the first waveguide section, the second waveguide section having a channel formed in the top surface of the substrate, wherein the channel defines a planar bottom surface that is recessed below the planar bottom surface of the channel in the first waveguide section, the second planar section having a v-shape groove formed in an end of the second waveguide section facing the output side surface, such that the v is parallel with bottom surface of the trench and the v opens towards the output side surface of the substrate; and an output waveguide section formed in the substrate adjacent to and integral with the second waveguide section, the output waveguide section having a channel formed in the top surface of the substrate and extending from the second waveguide section to the output side surface of the substrate, wherein the channel is sized to receive a rectangular waveguide.

9. The apparatus of claim 8 wherein a rigid metal-coated dielectric membrane is deposited over top the in-plane transition waveguide.

10. The apparatus of claim 9 wherein a metal is deposited onto top exposed surface of the in-plane transition waveguide prior to depositing the rigid metal-coated dielectric membrane.

11. The apparatus of claim 10 wherein the trench includes a first section and a second section, wherein the first section of the trench is adjacent to the input side surface and has a width smaller than the width of the channel in the first waveguide section, and the second section of the trench tapers from width of the first section to a width that is substantially the same as the width of the channel in the first waveguide section.

12. The apparatus of claim 11 wherein height of the channel in the output waveguide section is equal to height of a standard size rectangular waveguide.

* * * * *